US010676965B2

(12) United States Patent
Roatis et al.

(10) Patent No.: US 10,676,965 B2
(45) Date of Patent: Jun. 9, 2020

(54) LOCKS FOR STORAGE CONTAINERS AND THE LIKE

(71) Applicant: TriTeq Lock and Security, L.L.C., Elk Grove Village, IL (US)

(72) Inventors: Calin V. Roatis, Long Grove, IL (US); Gabriel Ribu, Niles, IL (US); William Denison, North Barrington, IL (US)

(73) Assignee: TriTeq Lock and Security, L.L.C., Elk Grove Village, IL (US)

( * ) Notice: Subject to any disclaimer, the term of this patent is extended or adjusted under 35 U.S.C. 154(b) by 0 days.

(21) Appl. No.: 15/885,094

(22) Filed: Jan. 31, 2018

(65) Prior Publication Data

US 2018/0305955 A1 Oct. 25, 2018

Related U.S. Application Data

(63) Continuation of application No. 15/284,469, filed on Oct. 3, 2016.

(Continued)

(51) Int. Cl.
*E05C 7/00* (2006.01)
*E05B 47/00* (2006.01)

(Continued)

(52) U.S. Cl.
CPC ..... *E05B 47/0045* (2013.01); *B65D 43/22* (2013.01); *E05B 13/002* (2013.01); *E05B 17/2034* (2013.01); *E05B 17/2038* (2013.01); *E05B 47/0038* (2013.01); *E05B 63/12* (2013.01); *E05B 65/5246* (2013.01); *E05C 3/042* (2013.01); *E05C 3/24* (2013.01); *E05C 7/00* (2013.01); *E06B 11/021* (2013.01)

(58) Field of Classification Search
CPC ..... E05B 47/0045; E05B 17/2038; E05B 47/0038; E05B 63/12; E05B 17/2034; E05B 13/002; E05B 11/021; E05B 65/5246; E05B 65/48; E05B 65/50; E05B 65/5269; E05B 65/5276; E05B 65/5284; B65D 43/22; B65D 43/161; B65D 43/16; E05C 7/00; E05C 3/042; E05C 3/24; E05C 7/02; E05C 7/04
USPC ... 70/2–13, 63–76, 105, 135, 136, 158–173, 70/DIG. 65; 109/67, 68; 292/281–286, 292/DIG. 21
See application file for complete search history.

(56) References Cited

U.S. PATENT DOCUMENTS 868,234 A * 10/1907 Tyden
1,993,002 A * 3/1935 Glaser ..... E05C 9/08 292/207

(Continued)

*Primary Examiner* — Lloyd A Gall
(74) *Attorney, Agent, or Firm* — Charles T. Riggs, Jr.

(57) ABSTRACT

Locks for storage containers having closures such as doors, covers or lids are disclosed. The lock is mounted to the closure and is latched in such a manner as to selectively prevent opening or removal of the closure. The latch of the lock can engage a slot in the storage container, a bracket on the storage container, or a strike on the storage container. Alternatively, the latch can engage a mounting bracket on the door or other portion of the door to selectively block movement of a handle for the door. Further, the latch can have a locking device which can selectively block movement of the latch. Movement of the locking device can be selectively controlled by a magnetic key.

18 Claims, 52 Drawing Sheets

Related U.S. Application Data

(60) Provisional application No. 62/236,967, filed on Oct. 4, 2015, provisional application No. 62/337,658, filed on May 17, 2016.

(51) Int. Cl.

| | |
|---|---|
| ***E05B 13/00*** | (2006.01) |
| ***E06B 11/02*** | (2006.01) |
| ***E05B 65/52*** | (2006.01) |
| ***B65D 43/22*** | (2006.01) |
| ***E05B 17/20*** | (2006.01) |
| ***E05B 63/12*** | (2006.01) |
| ***E05C 3/04*** | (2006.01) |
| ***E05C 3/24*** | (2006.01) |

(56) References Cited

U.S. PATENT DOCUMENTS 2,716,882 A * 9/1955 Vold ..... G07F 9/10 70/159
2,920,915 A * 1/1960 Ducharme ..... A01K 1/035 292/87
3,040,555 A * 6/1962 Wartian ..... E05B 65/0811 292/106
3,201,960 A * 8/1965 Berkowitz ..... E05C 19/16 292/126
3,250,558 A * 5/1966 McClintock ..... E05C 3/048 292/207
3,378,323 A * 4/1968 Goldberg ..... B65F 1/1426 211/83
3,572,796 A * 3/1971 Willner ..... E05C 19/08 292/205
4,286,814 A * 9/1981 Harrington ..... E05B 65/48 292/148
4,438,964 A * 3/1984 Peters ..... E05C 3/24 292/173
4,453,743 A * 6/1984 Sanders ..... B42D 3/10 281/18
4,475,365 A * 10/1984 Swisher ..... E05B 65/0089 70/159
4,896,070 A * 1/1990 Reid ..... A47B 81/06 220/826
4,998,424 A * 3/1991 Lambert, II ..... A47G 29/20 109/45
5,154,459 A * 10/1992 Cochran ..... E05C 19/18 292/205
5,462,320 A * 10/1995 Davis ..... E05B 17/10 29/434
5,768,923 A * 6/1998 Hill ..... E05B 9/084 70/370
5,988,376 A * 11/1999 Lax ..... E05B 73/0023 206/1.5
6,155,616 A * 12/2000 Akright ..... E05B 5/00 292/198
6,520,405 B1 * 2/2003 Braxter ..... A47G 29/1209 232/45
6,557,385 B1 * 5/2003 Shih ..... H05K 5/0208 16/366
6,705,136 B2 * 3/2004 Porter ..... E05B 47/0002 109/59 R
6,945,451 B1 * 9/2005 Bridges ..... A47G 29/12 232/19
7,257,971 B2 * 8/2007 Lax ..... B65D 50/067 206/1.5
7,266,979 B2 * 9/2007 Belden, Jr. ..... E05B 73/0041 206/1.5
7,565,999 B1 * 7/2009 Jensen ..... G07F 17/42 220/210
7,578,531 B1 * 8/2009 Leontaridis ..... E05B 65/0835 292/11
8,397,546 B2 * 3/2013 Varney ..... E05B 47/004 292/194
2005/0023841 A1 * 2/2005 Chen ..... E05C 19/16 292/251.5
2008/0054648 A1 * 3/2008 Baragano Gonzalez ..... E05B 47/0002 292/71
2009/0115204 A1 * 5/2009 Rycroft ..... E05B 63/20 292/341.17
2013/0043250 A1 * 2/2013 Kreidler ..... A61L 2/26 220/324
2015/0252591 A1 * 9/2015 Roatis ..... E05B 37/00 70/277
2018/0305955 A1 * 10/2018 Roatis ..... E05B 47/0045

* cited by examiner

Locked

UNLOCKED

Closed

LOCKS FOR STORAGE CONTAINERS AND THE LIKE

RELATED APPLICATIONS

This application relates to and claims priority to U.S. provisional patent application No. 62/236,967 titled "Locks", filed Oct. 4, 2015, and U.S. provisional patent application No. 62/337,658 titled "Locks", filed May 15, 2016, the entire disclosures of which are incorporated herein.

TECHNICAL FIELD

The exemplary teachings herein pertain to locking and/or latching mechanisms, and method(s), system(s) and device(s) for latching and/or locking an enclosure, such as a storage container, bin, crate, cage or other lockable enclosure. In particular, the present disclosure relates to one or more locks for a storage container, bin, crate, cage or other lockable enclosure having a lid, cover, door or other closure device, and being selectively operable manually, electronically, magnetically and/or mechanically.

BACKGROUND

Storage containers come in all different shapes and sizes and are useful in storing and protecting items placed within the enclosure of the storage container. Further, storage containers may have different types of lids, covers, doors or other closure devices. For example, such storage containers may be a storage bin with an operable cover, a storage bin with a hinged door or doors, a crate with a wire cage door, etc.

In warehouses or stock rooms, such storage containers are particularly useful to define a unit of space that can be used to place, hold and store items, stock, product and/or inventory. Such storage bins help keep similar items in one area while keeping those items separate from other items and/or preventing loose items from falling through shelving, racks, etc. Storage bins allow people to easily handle and/or transport a small number of items or stock, without the need to move and separate items from a larger box, shipping container or pallet, which might require more time and equipment. Storage bins containing a small number of items can be placed on easily accessible lower shelves, while remaining stock placed on overhead racks. This can create a well-organized and efficient system that allows people to easily access items without the need of a ladder or lift device.

However, such storage containers often lack a latch, lock or similar mechanism to latch and/or lock an associated cover, lid or door to the container. As a result, items in the container can inadvertently or unintentionally become separated from or fall out of the container should the cover, lid or door become opened or displaced from the container. Further, the lack of a latch, lock or similar mechanism thus fails to prevent or deter unauthorized access to or theft of the items in the storage containers.

Therefore, a need exists for one or more methods, systems and devices which are directed towards securing storage containers by latching and/or locking the cover, lid, door or other closure device to the storage container. Accordingly, to address the above stated issue(s) and other issue(s), the method(s), system(s) and device(s) disclosed herein fulfill this and other such needs.

SUMMARY

The exemplary technique(s), system(s), device(s) and method(s) presented herein relate to locks for storage containers. The locks can be attached to or integrated into the storage container and/or a lid, cover, door or other closure device for the storage container to secure the lid, cover, door or other closure device to the storage container. The locks can be provided OEM (original equipment manufacturer) or can be retrofitted to an existing storage container and/or closure device.

In one embodiment, a lock for a storage bin with a lid is provided. The lock comprises a base having a knob which operates a T-shaped latch. The T-shaped latch selectively engages a skit area to seems the lid to the storage bin.

In another embodiment, a lock for a box with a double wire cage door or doors is provided. The lock, comprises a base having a knob which operates a latch element which may be in the form of a cam. The lock is mounted on a pivotable bracket. The cam selectively engages a wire door area to secure the doors of the box.

In another embodiment, a lock for a box with a single wire cage door or doors is provided. The lock comprises a base having a knob which operates a latch element which may be in the form of a cam. The lock is mounted on a pivotable bracket having a strike plate or surface. The cam selectively engages a slot area on the bracket to secure the door to the box.

In another embodiment, a lock for a box with a wire cage door or doors is provided. The lock comprises a base having a knob which operates a latch element which may be in the form of a spring biased bolt. The lock is mounted on a pivotable bracket having a strike plate or surface. The spring biased holt selectively engages a hole area on the bracket to secure the door to the box.

In another embodiment, a magnetic lock for a storage bin with a lid is provided. The lock comprises a base having a knob which operates a T-shaped latch. The T-shaped latch selectively engages a slot area to secure the lid to the storage bin. The base also includes a spring biased latching mechanism to selectively prevent, the knob from turning. The latching mechanism includes one or more spring biased magnets to selectively prevent the latching mechanism from moving. A magnet key interact with the one or more spring biased magnets to selectively allow the latching mechanism to move to allow the knob to turn.

In another embodiment, a magnetic lock for a storage bin with a lid is provided. The lock comprises a base having a knob which operates a T-shaped latch. The T-shaped latch selectively engages a slot urea to secure the lid to the storage bin. The base also includes a spring biased latching mechanism to selectively prevent the knob from turning. The latching mechanism includes a spring biased toggle with one or more magnets to selectively prevent the latching mechanism from moving. A magnet key interacts with the one or more magnets to selectively its move the toggle to allow the latching mechanism to move to allow the knob to turn.

In another embodiment, a lock for a storage bin with two swinging hinged covers is provided. The lock comprises a base having a knob which operates a T-shaped latch. The lock is mounted to a hinged plate attached to a bracket connected to one hinged cover and selectively overlaying the other hinged cover. The T-shaped latch selectively engages a slot area of a bracket attached to the bin to secure the lid to the storage bin.

In another embodiment, a magnetic lock for a cage or crate with a wire cage door is provided. The lock comprises a base having a spring biased rotor latch. The rotor latch selectively engages a strike on the cage to secure the door to the cage. The base also includes a spring biased latching mechanism to selectively prevent the rotor latch from rotating. The latching mechanism includes one or more spring biased magnets to selectively prevent the latching mechanism from moving. A magnet key interacts with the one or more spring biased magnetic elements to selectively allow the latching mechanism to move to allow the rotor latch to rotate.

Additional objects, advantages and novel features will be set forth in part in the description which follows, and in part will become apparent to those skilled in the art upon examination of the following and the accompanying drawings or may be learned by production or operation of the examples.

BRIEF DESCRIPTION OF THE DRAWINGS

The drawing figures depict one or more implementations in accord with the present teachings, by way of example only, not by way of limitation. In the drawing figures, like reference numerals refer to the same or similar elements.

DETAILED DESCRIPTION

The following description refers to numerous specific details which are set forth by way of examples to provide a thorough understanding of the relevant teachings. It should be apparent to those skilled in the art that the present teachings may be practiced without such details. In other instances, well known methods, procedures, and components have been described at a relatively high-level, without detail, in order to avoid unnecessarily obscuring aspects of the present teachings.

FIGS. 1-12 illustrate a first embodiment of a lock for a storage container. In this embodiment, the lock is illustrated as a manually or electronically actuated lock mounted to or in the lid of a storage bin, and selectively engaging an area or portion of the storage bin to secure the lid to the storage bin. Use of this lock with storage containers and lids of any suitable size and shape are contemplated. Further, it should be understood that the lock of this embodiment can be used with any type of storage container and any type of lid, cover, door or other closure device wherein the lock can be integrated on either the lid for engagement with the container, or on the container for engagement with the lid.

Figure 1:
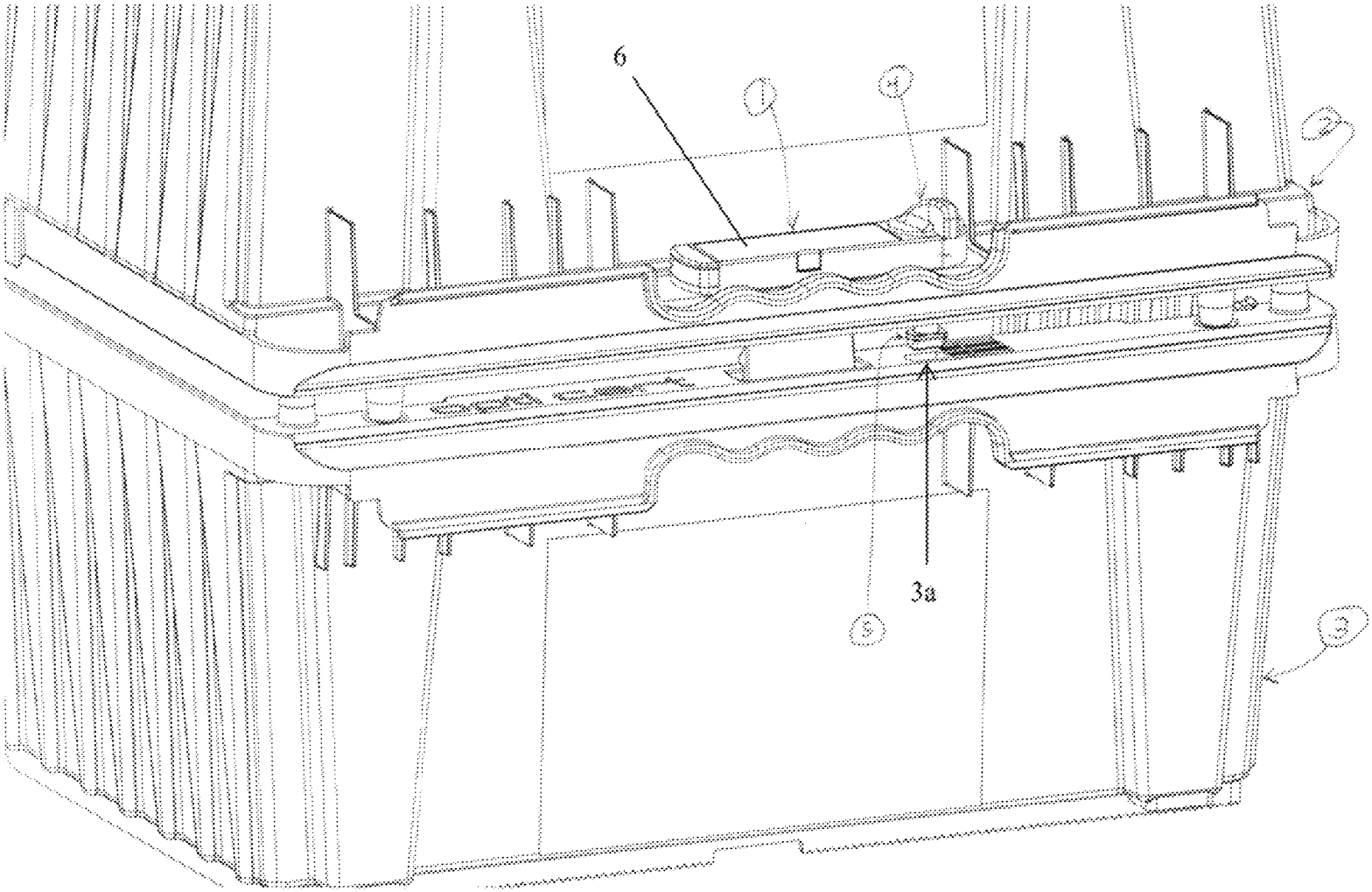
FIG. 1 is a perspective view of a first embodiment of a lock for a storage bin with a lid, and illustrating the lid spaced from the bin with the lock in an unlocked position.
Figure 7:
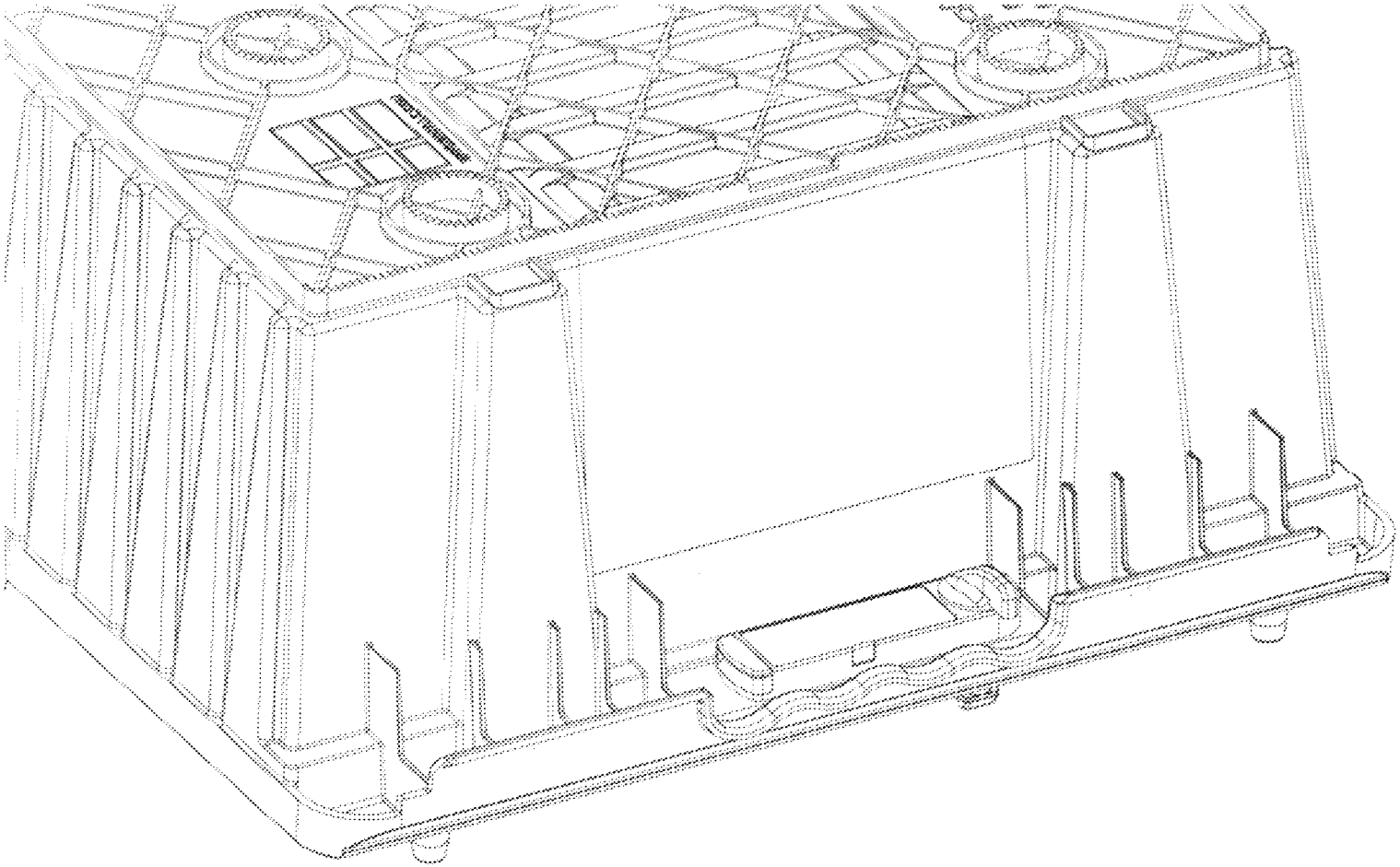
FIG. 7 is a top perspective view of the first embodiment, and illustrating the lock-mounted to the lid with the lock in the unlocked position.

FIG. 1 illustrates the lock 1 mounted to the lid 2 of the bin 3 with the lid separated from the bin. As illustrated, the lid 2 resembles an upside down bin 3. However, it should be understood that the lid could take the form of a shallow lid, or a generally flat lid or other shape. The lid may be hinged on the side of the bin opposite the lock. Alternatively, two locks can be used on opposite sides of the bin to selectively secure the lid to the bin. FIG. 7 illustrated the lid of FIG. 1 by itself, with the lock thereon.

The lock 1 has a base 6 in which a knob 4 is operatively set. The knob 4 of the lock 1 actuates a T-shaped latch 5 or other suitable latch which extends from and is suitably affixed to the knob 4. Rotation of the knob 4 thus rotates the T-shaped latch 5. In FIG. 1, the knob 4 is shown rotated to the unlocked position and the T-shaped latch 5 in the unlatched position.

Figure 4:
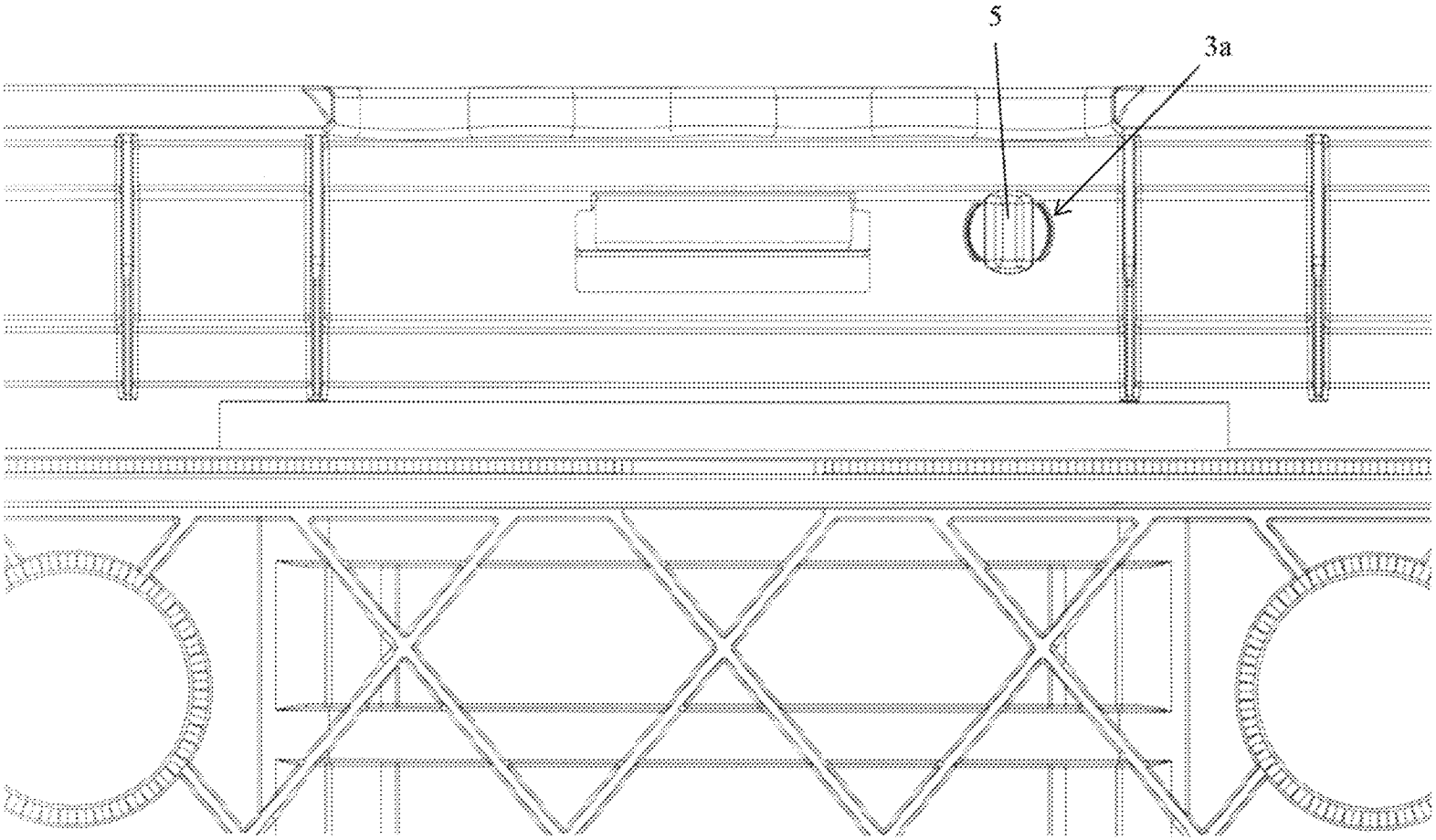
FIG. 4 is a partial bottom view of FIG. 3.

The lock 1 is placed along a rim or ridge of the lid, preferably in a central location as illustrated. The opposing rim or ridge on the bin 3 includes a latch opening 3*a* which is approximately equal or slightly larger in size and shape to the T-shaped latch 5. The latch opening is located in the rim or ridge of the bin 3 such that it aligns with the T-shaped latch when the lid is properly placed on the bin. As such, when the T-shaped latch 5 is in its unlatched position, it will extend into and through the opening 3*a* in the rim or ridge of the bin. Thereafter, when the knob 4 is rotated, the ends of the T-shaped latch 5 will rotate under and abut an area of the rim or ridge of the bin about the side edges of the opening 3*a*, thereby securing the lid to the bin, as illustrated in FIG. 4. It should be understood that the opening 3*a* can take any suitable size and shape which will allow a latch of any size and shape to pass therethrough in an unlatched position, and to engage the rim in a latched position. It should also be understood that a suitably sized and shaped opening is formed in the rim or ridge of the lid to allow the T-shaped latch to pass therethrough when the base 6 of the lock 1 is mounted on the lid 2.

Figure 2:
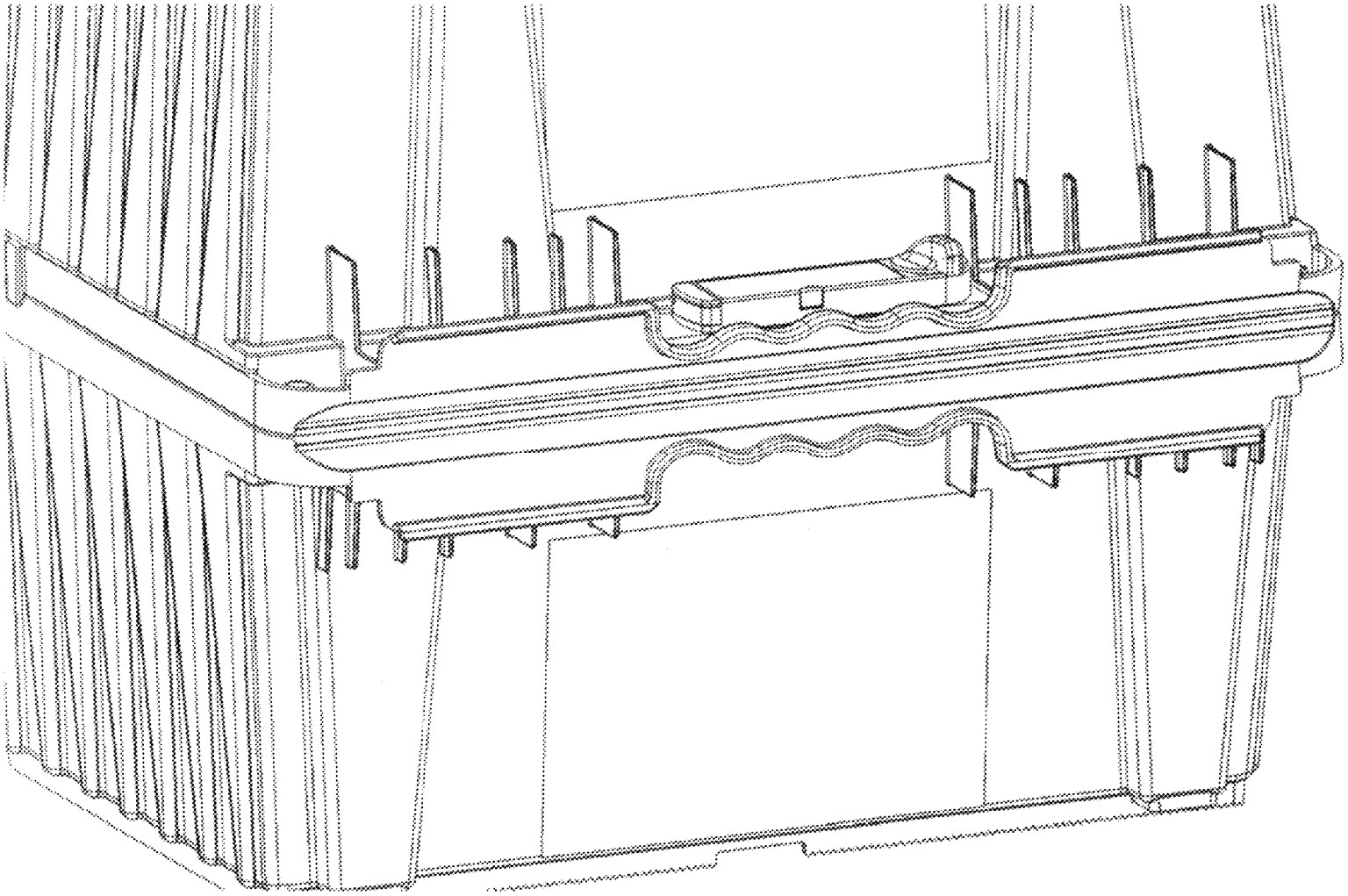
FIG. 2 is a perspective view of the first embodiment, and illustrating the lid seated on the bin with the lock in an unlocked position.
Figure 3:
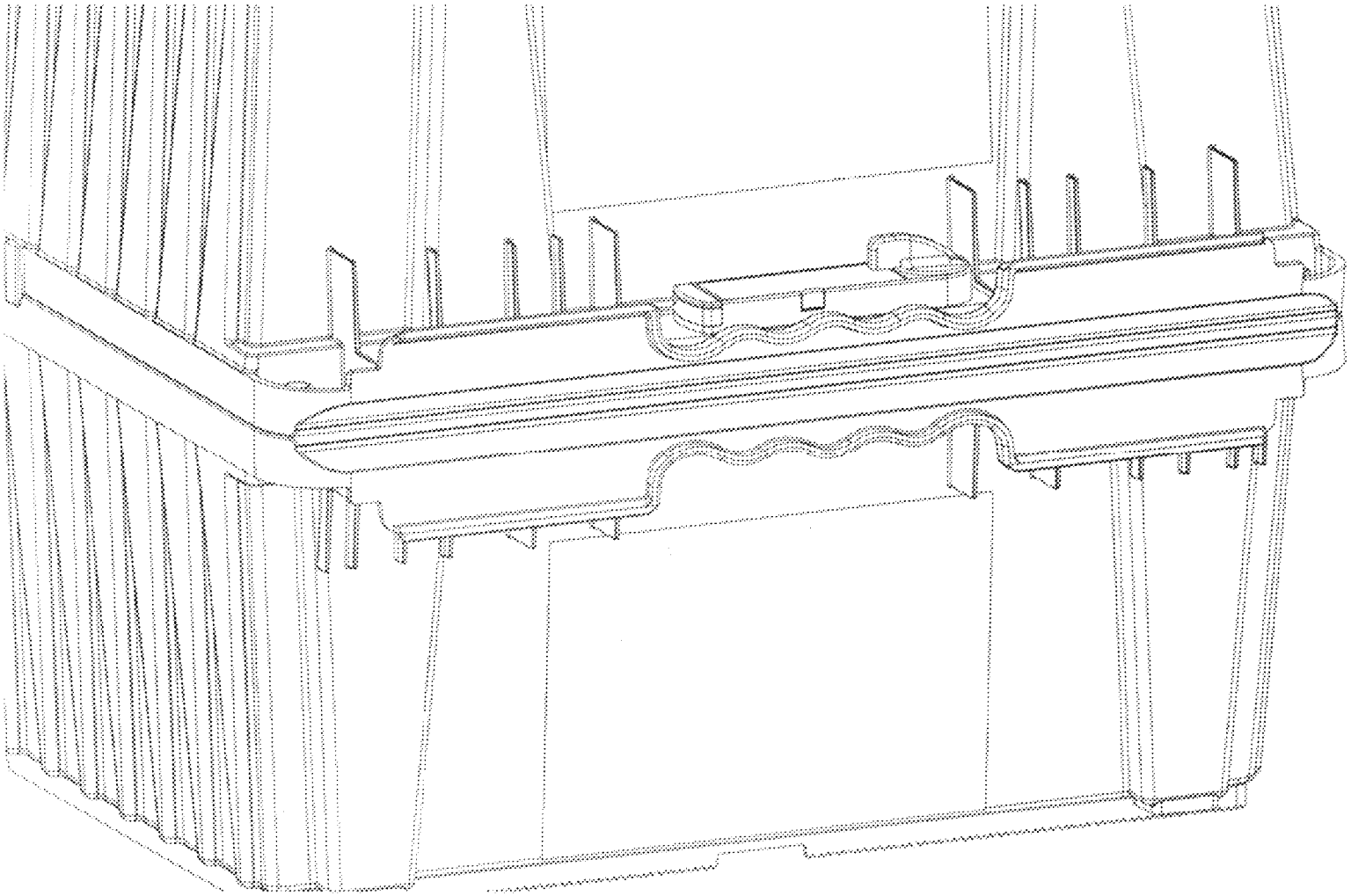
FIG. 3 is a perspective view of the first embodiment, and illustrating the lid seated on the bin with the lock in a locked position.
Figure 5:
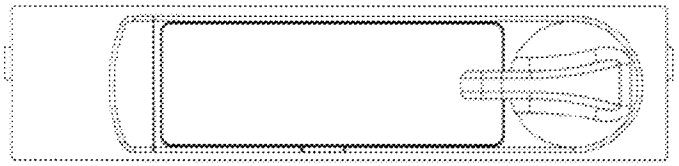
FIG. 5 is a top view of the lock of the first embodiment in the locked position.
Figure 6:
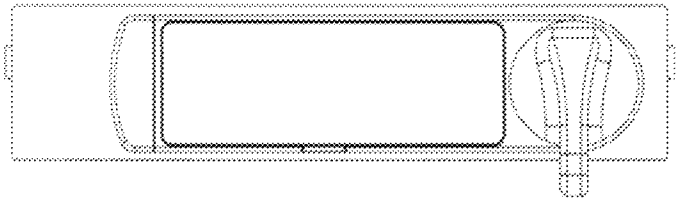
FIG. 6 is a top view of the lock of the first embodiment in the unlocked position.

FIG. 2 shows the bin with the lid seated on the bin. The knob is in the unlocked position, as illustrated in FIG. 5. Although hidden from view, the T-shaped latch has extended though the opening 3*a* when the lid is seated on the bin as illustrated. In FIG. 3, the knob has been rotated to the locked position, as illustrated in FIG. 6. Although hidden from view, the ends of the T-shaped latch have rotated under an area of the rim or ridge of the bin about the side edges of the opening 3*a*, as illustrated in FIG. 4.

Figure 8:
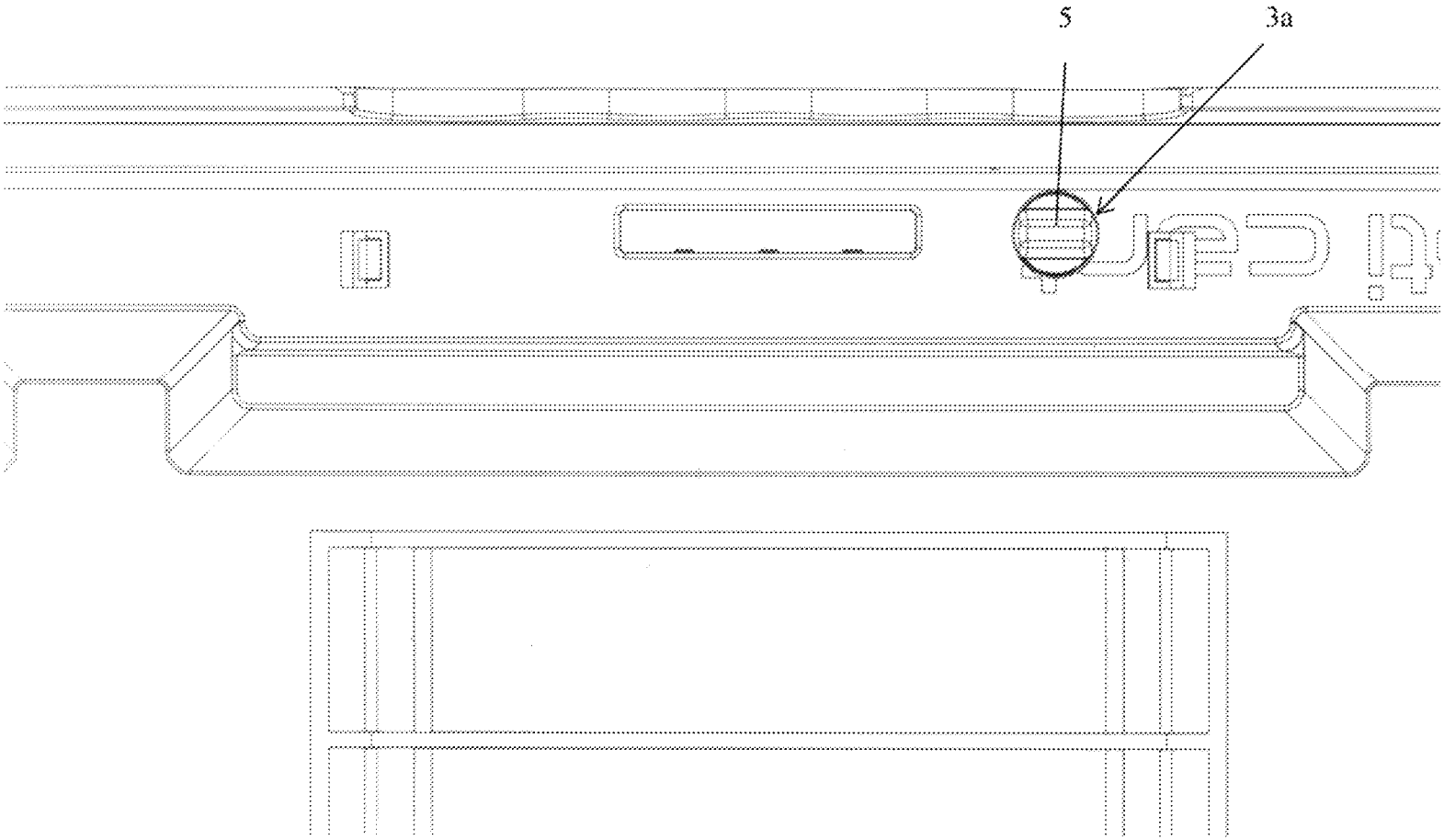
FIG. 8 is a partial bottom view of FIG. 2.

FIG. 4 shows in a bottom view the T-shaped latch 5 of the lock in the locked position capturing the lid to the bin. The two ends of the T-shaped latch 5 have rotated under and abut an area of the rim or ridge of the bin about the side edges of the opening 3*a*, as illustrated. FIG. 8 shows in a bottom view the T-shaped latch 5 of the lock in the unlocked position allowing the lid to be lifted from the bin. The two ends of the T-shaped latch 5 are aligned with the opening 3*a*, as illustrated.

Figure 9:
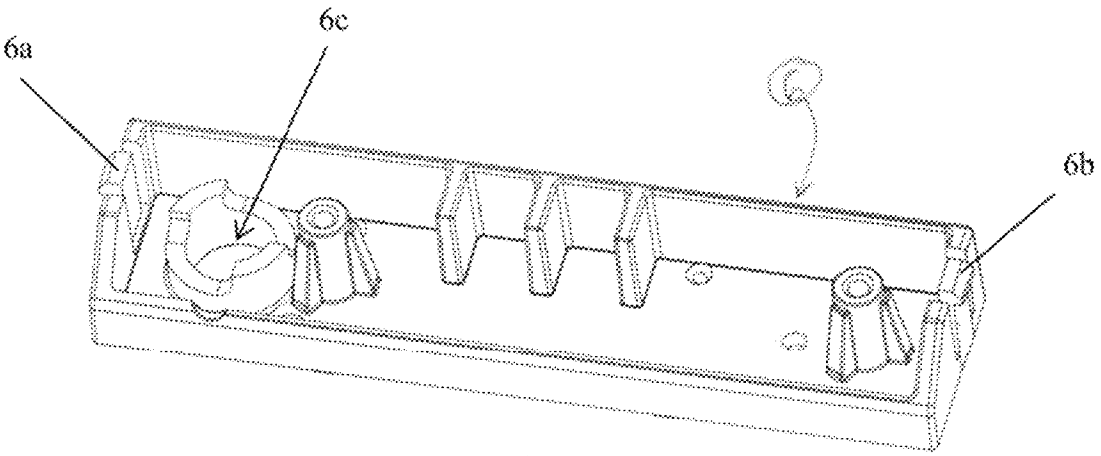
FIG. 9 is a bottom perspective view of the base portion of the lock of the first embodiment.
Figure 10:
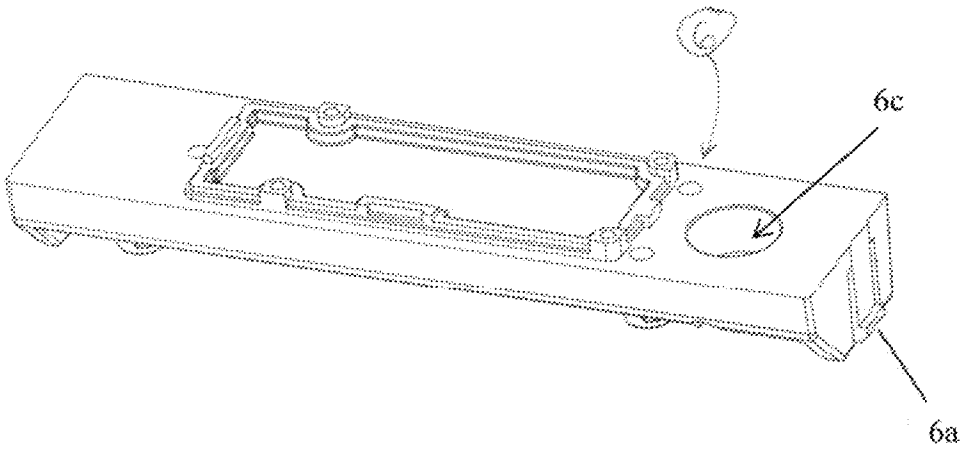
FIG. 10 is a top perspective view of the base portion of the lock of the first embodiment.

FIG. 9 (bottom perspective view) and FIG. 10 (top perspective view) illustrate the base 6 of the lock 1. The base 6 includes latches or clips 6*a* and 6*b* on each end to attach the base 6 to the lid. The base 6 includes an opening 6*c* in which the knob 4 of lock 1 is set. It should be understood that the rim or ridge of the lid will have a suitably configured mounting block or area where the base 6 of the lock can be mounted, with the latches or clips 6*a* and 6*b* holding the base 6 thereto.

Figure 11:
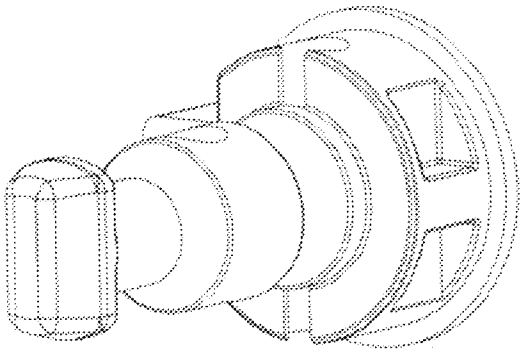
FIG. 11 is a perspective view of the knob with attached latch of the lock of the first embodiment.
Figure 12:
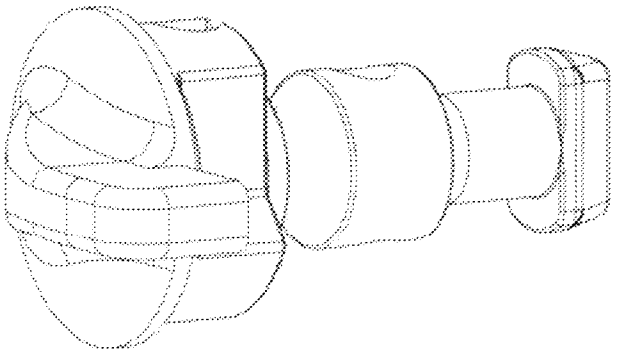
FIG. 12 is a perspective view of the knob with detached latch of the lock of the first embodiment.

FIG. 11 shows the T-shaped latch 5 connected to the knob 4 of the lock. FIG. 12 shows the knob 4 separated from the T-shaped latch 5. The knob 4 and T-shaped latch 5 can be connected in any suitable manner which will allow the T-shaped latch 5 to be rotated when the knob 4 is rotated. Alternatively, the knob 4 and T-shaped latch 5 can be a single, integral component.

To latch and unlatch the lock, the knob 4 can be rotated manually by the user. Alternatively, the knob and latch can be actuated electronically, such as by an electric motor and controller.

FIGS. 13-16 illustrated a second embodiment for locking a storage box with single or double swinging wire/cage door(s). In this embodiment, the lock is illustrated as a manually or electronically actuated lock mounted to a door of the storage box, and selectively engaging an area or portion of the other door to secure the door(s) to the storage bin. Use of this lock with storage containers and doors of any suitable size and shape are contemplated. Further, it should be understood that the lock of this embodiment can be used with any type of storage container and any type of door wherein the lock can be integrated on either door for engagement with the other door. It should be understood that one of the doors could be fix, or could be a wall or side of the storage box instead of a second door.

FIGS. 13-16 shows the storage box 7 with swinging doors 8*a* and 8*b*. Lock 9 is mounted to a mounting bracket 10 which has a first bracket portion 10*a* and a second bracket portion 10*b*. The bracket 10 may be shaped similar to a padlock hasp bracket. First bracket portion 10*a* and a second bracket portion 10*b* are connected via a hinge 12. First bracket portion 10*a* is suitably mounted to door 8*a*, and can attach to the door 8*a* for example by clasping to a wire surface of the door. The lock 9 is suitably mounted to second bracket portion 10*b*. Hinge 12 allows the second bracket portion 10*b* and lock 9 thereon to pivot to and away from the door(s) when the lock 9 is unlocked and unlatched.

Figure 13:
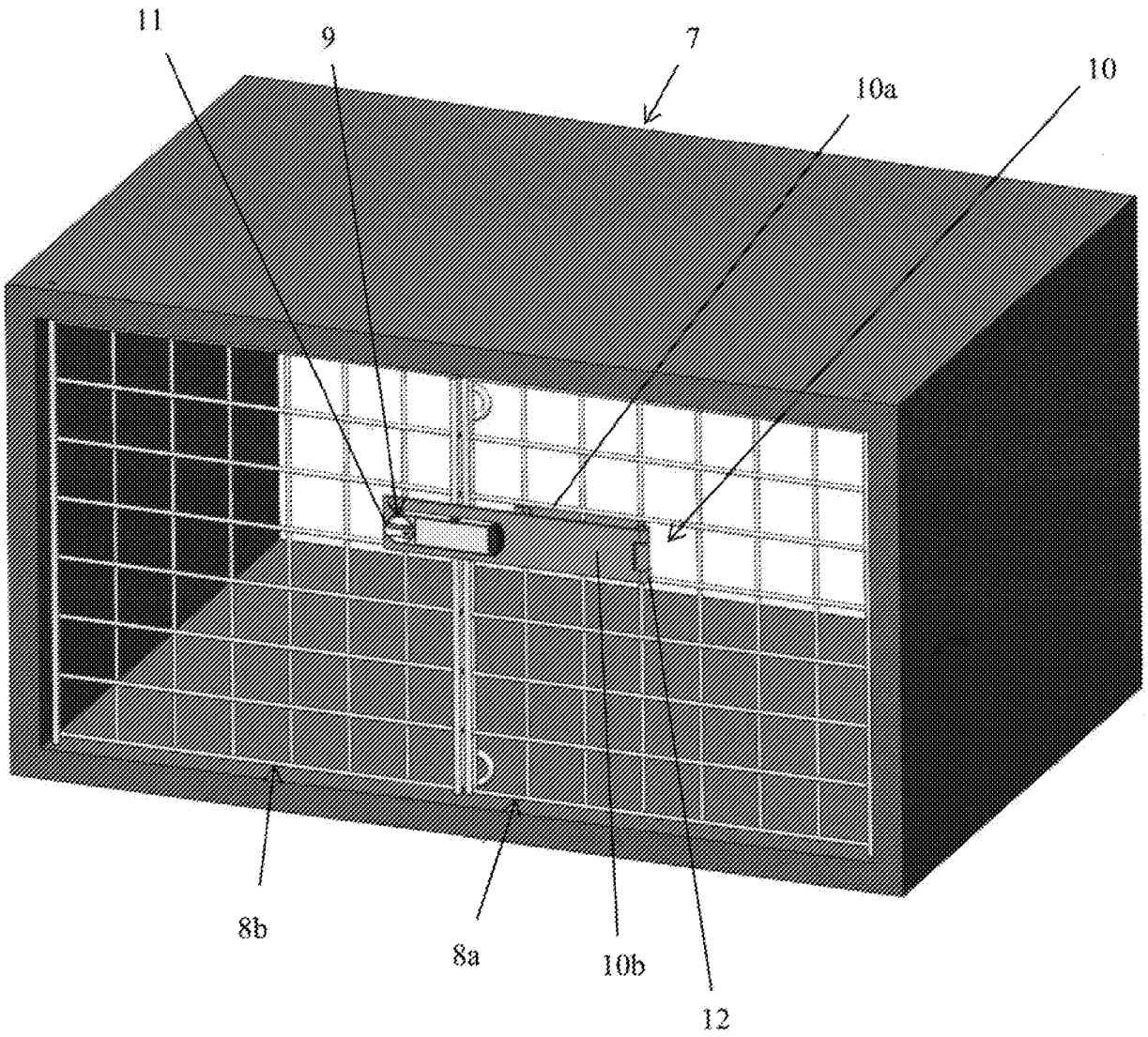
FIG. 13 is a perspective view of a second embodiment of a lock for a storage box with a double wire cage door, and illustrating the door closed and the lock bracket closed with the lock in a locked position.
Figure 14:
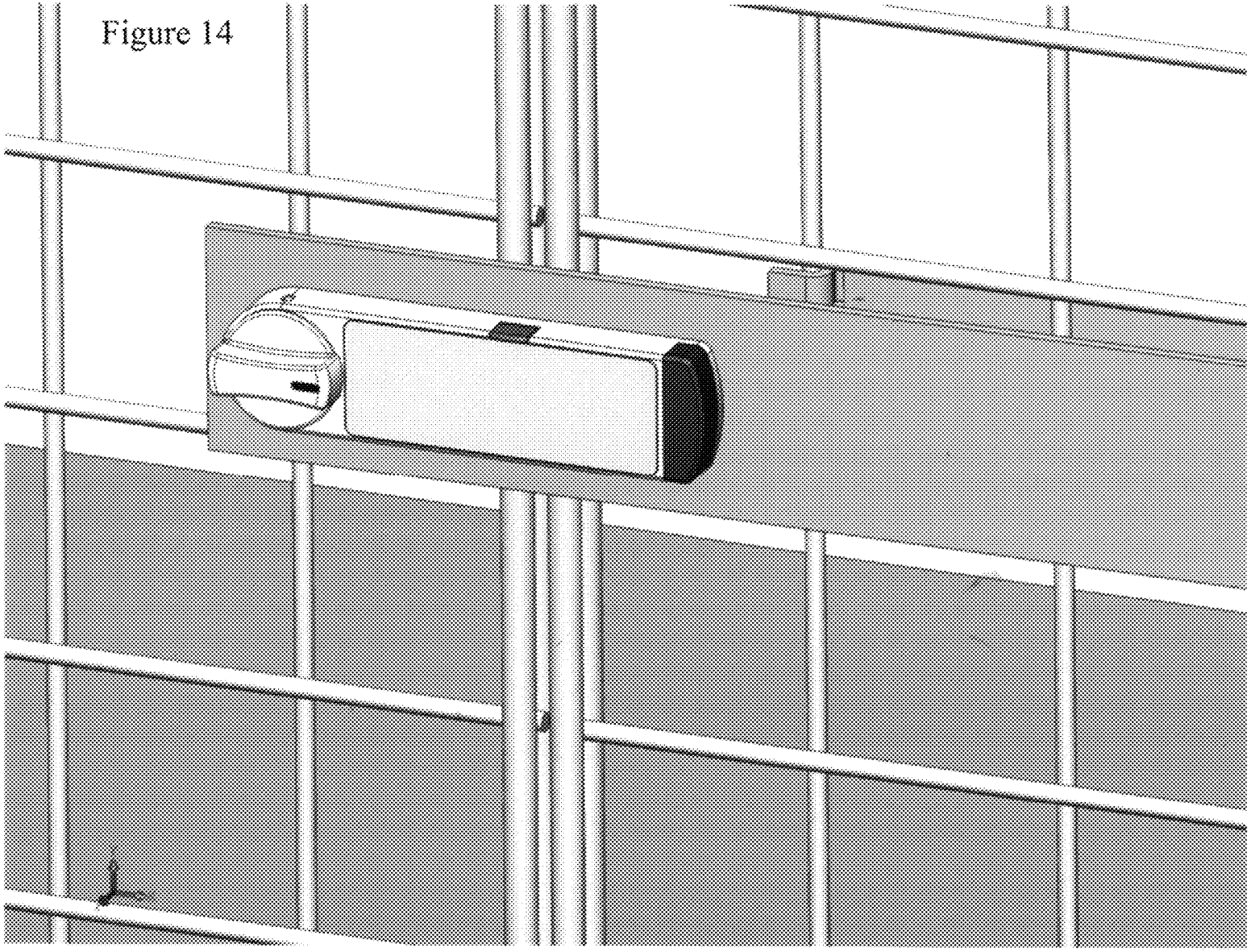
FIG. 14 is a partial enlarged front perspective view of FIG. 13.
Figure 15:
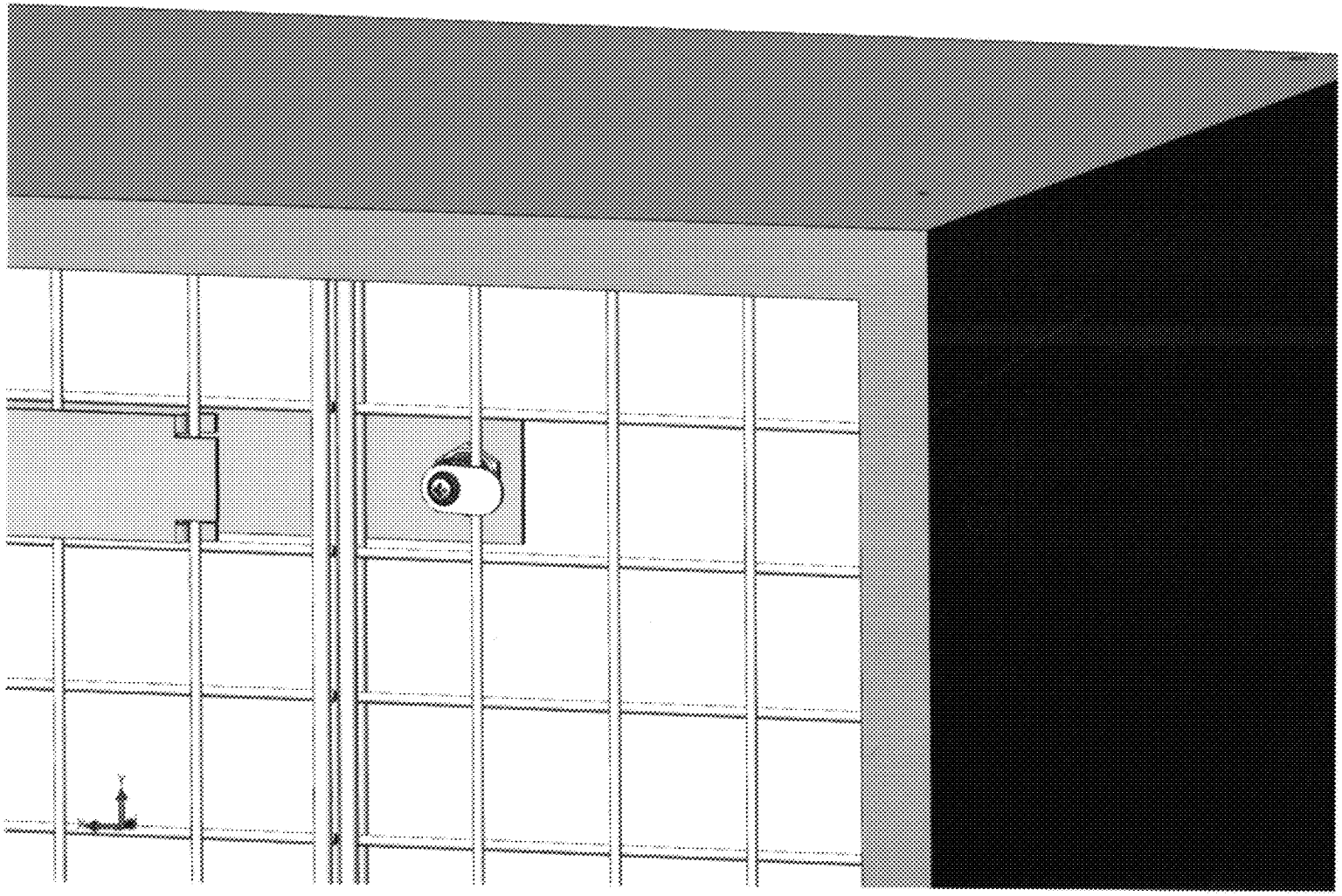
FIG. 15 is a partial enlarged rear perspective view of FIG. 13.
Figure 16:
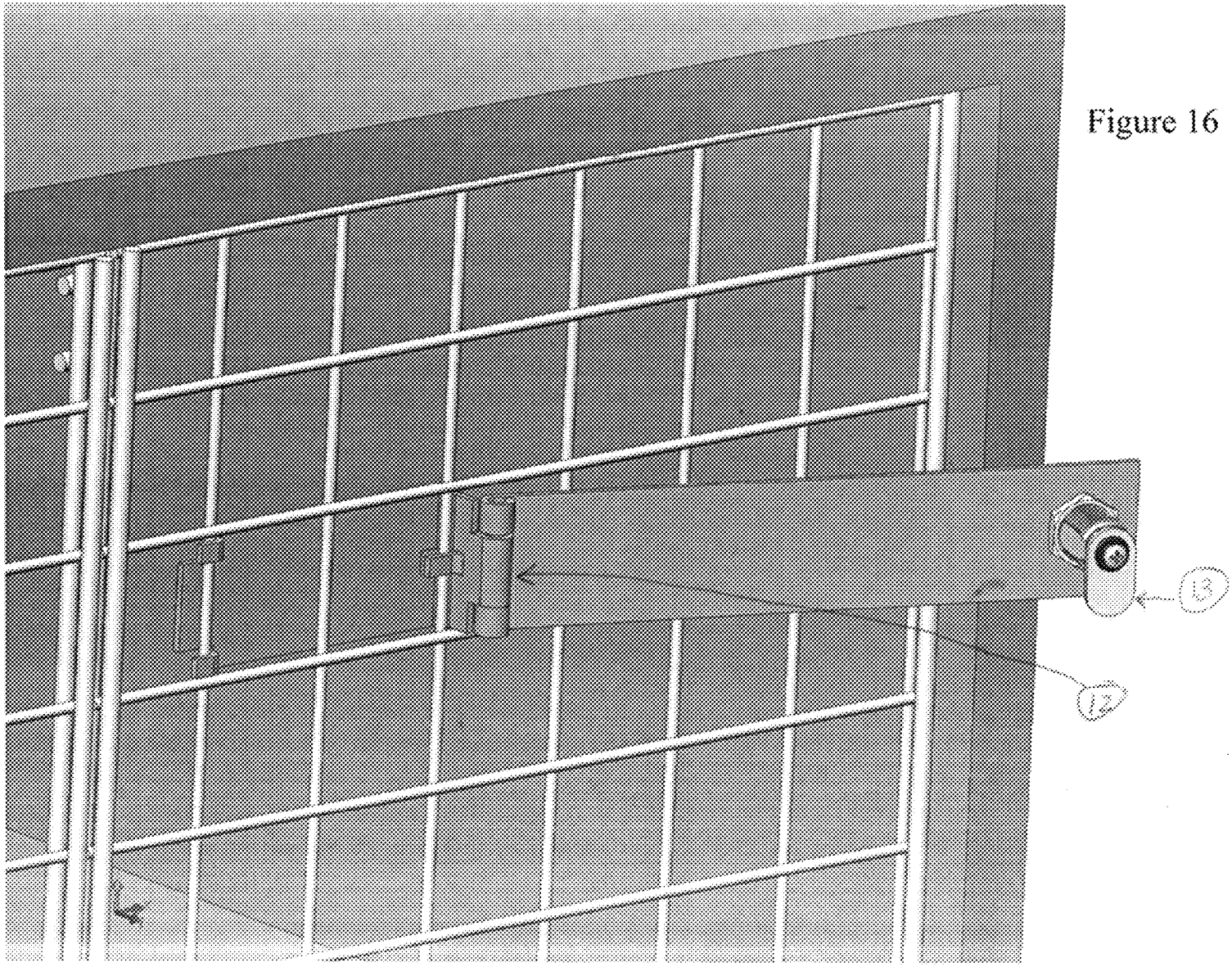
FIG. 16 is a partial enlarged front perspective view of the second embodiment, and illustrating the door closed and the lock bracket opened with the lock in an unlocked position.

As shown in FIGS. 15 and 16, the lock 9 has a cam 13 as a latch element. The lock 9 has a knob 11, as can be seen in FIGS. 13 and 14, for actuating the cam 13. As can be seen, in FIG. 15, the cam 13 is selectively latched behind a section of door 8*b*. Alternatively, the cam 13 an also latch behind a separate receptacle or lock plate (not shown). In FIG. 16, the cam 13 is in the unlatched position allowing the lock 9 and the second bracket portion 10*b* to pivot, thereby allowing the doors to swing open.

FIGS. 17-21 illustrate a third embodiment for locking a storage box with single or double swinging wire/cage door(s) having a door latch and door handle. In this embodiment, the lock is illustrated as a manually or electronically actuated lock mounted to a door of the storage box, and selectively engaging an area or portion of a bracket on the door to secure the door to the storage box. Use of this lock with storage containers and doors of any suitable size and shape are contemplated. Further, it should be understood that the lock of this embodiment can be used with any type of storage container and any type of door wherein the lock can be integrated on a door for engagement with a door handle to selectively present movement of a door latch.

In the embodiment of FIGS. 17-21, door 14 of the storage box (not shown) can swing to open when door latch 15 is lifted vertically by door handle 17 to disengage the latch 15 from the storage box. Lock 16 is mounted to a mounting bracket 18 which has a first bracket portion 18*a* and a second bracket portion 18*b*. The bracket 18 may be shaped similar to a padlock hasp bracket. First bracket portion 18*a* and a second bracket portion 18*b* are connected via a hinge 20. First bracket portion 18*a* is suitably mounted to door 14, and can attach to the door 14 for example by clasping to a wire surface of the door. The lock 16 is suitably mounted to second bracket portion 18*b*. Hinge 20 allows the second bracket portion 18*b* and lock 16 thereon to pivot to and away from door 14 when the lock 16 is unlocked and unlatched.

Figure 20:
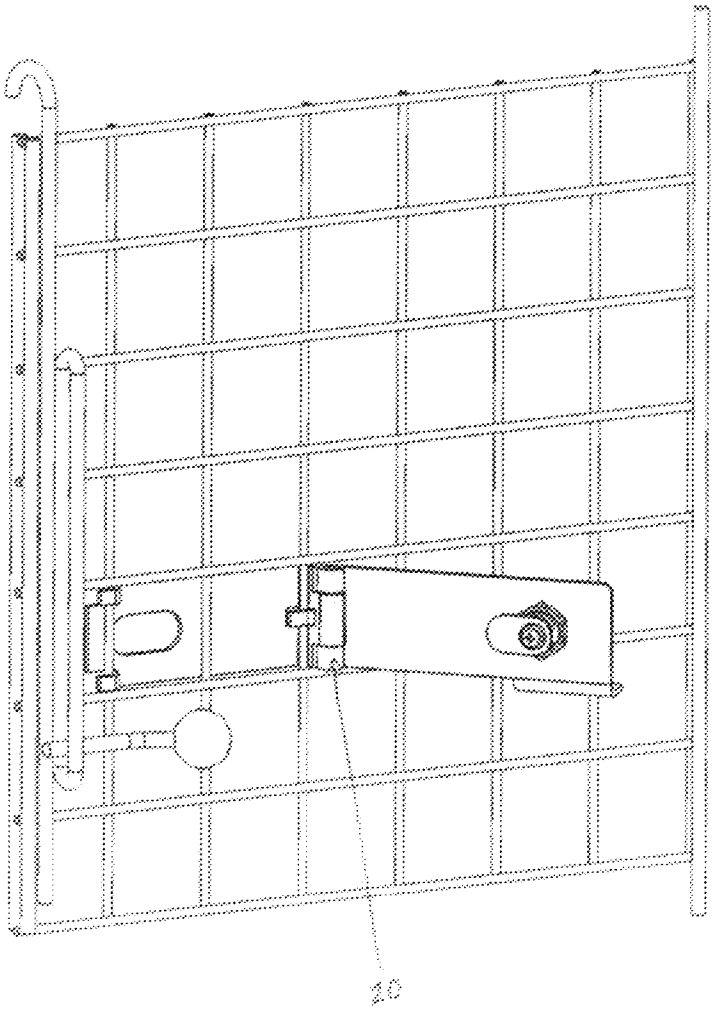
FIG. 20 is a front perspective view of the third embodiment illustrating the lock bracket opened and the door latch in a locked position.
Figure 21:
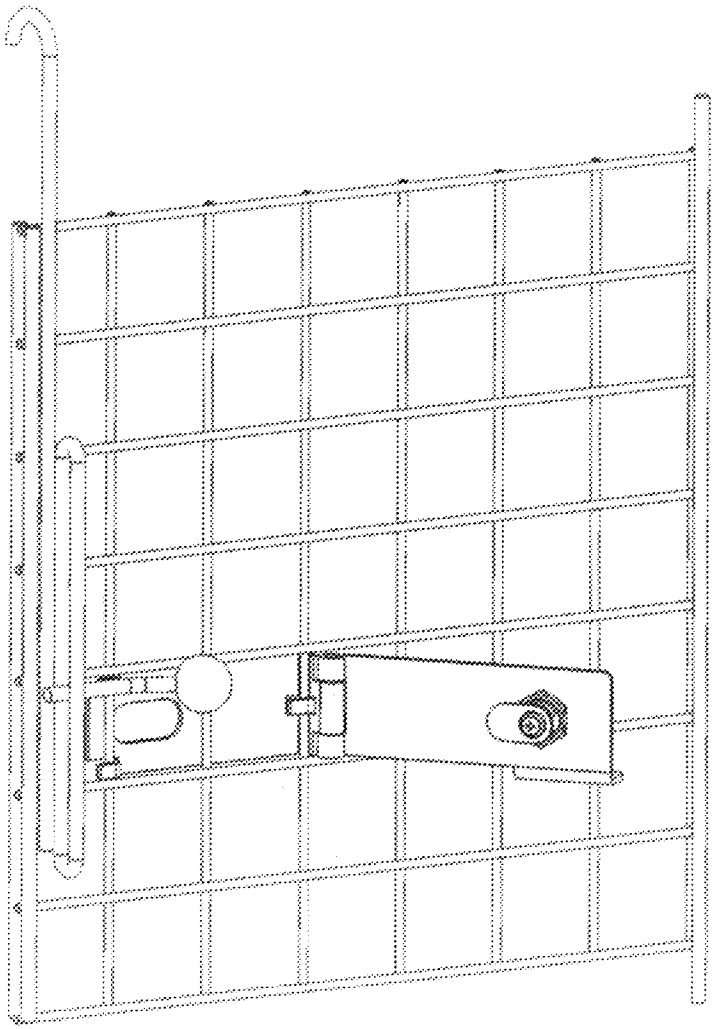
FIG. 21 is a front perspective view of the third embodiment illustrating the lock bracket opened and the door latch in an unlocked position.

A strike plate 18*c* is also mounted to or formed integral with second bracket portion 18*b*. Plate 18*c* extends from second bracket portion 18*b* in such a manner so as to prevent the handle 17 from being lifted to unlatch latch 15 when the lock 16 is locked. For example, plate 18*c* can extend perpendicular to second bracket portion 18*b* and over handle 17 as illustrated. However, other configurations are contemplated so long as handle 17 cannot function to unlatch latch 15 when the lock 16 is locked. Hinge 20 allows the second bracket portion 18*b*, lock 16 and plate 18*c* thereon to pivot to and away from door 14 when the lock 16 is unlocked and unlatched, as shown in FIGS. 20 and 21.

Figure 17:
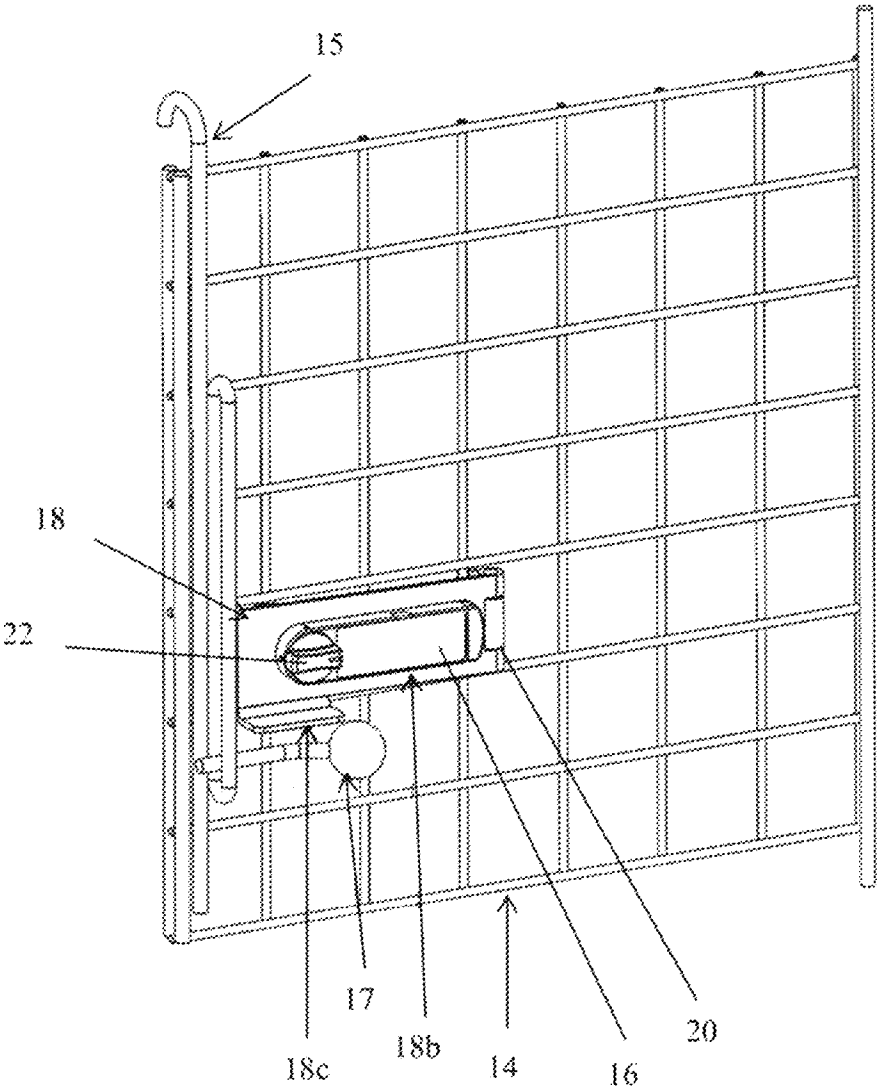
FIG. 17 is a front perspective view of a third embodiment of a lock for use in connection with a storage box with a single wire cage door, and illustrating the single wire cage door with the lock bracket closed and the lock in a locked position.
Figure 18:
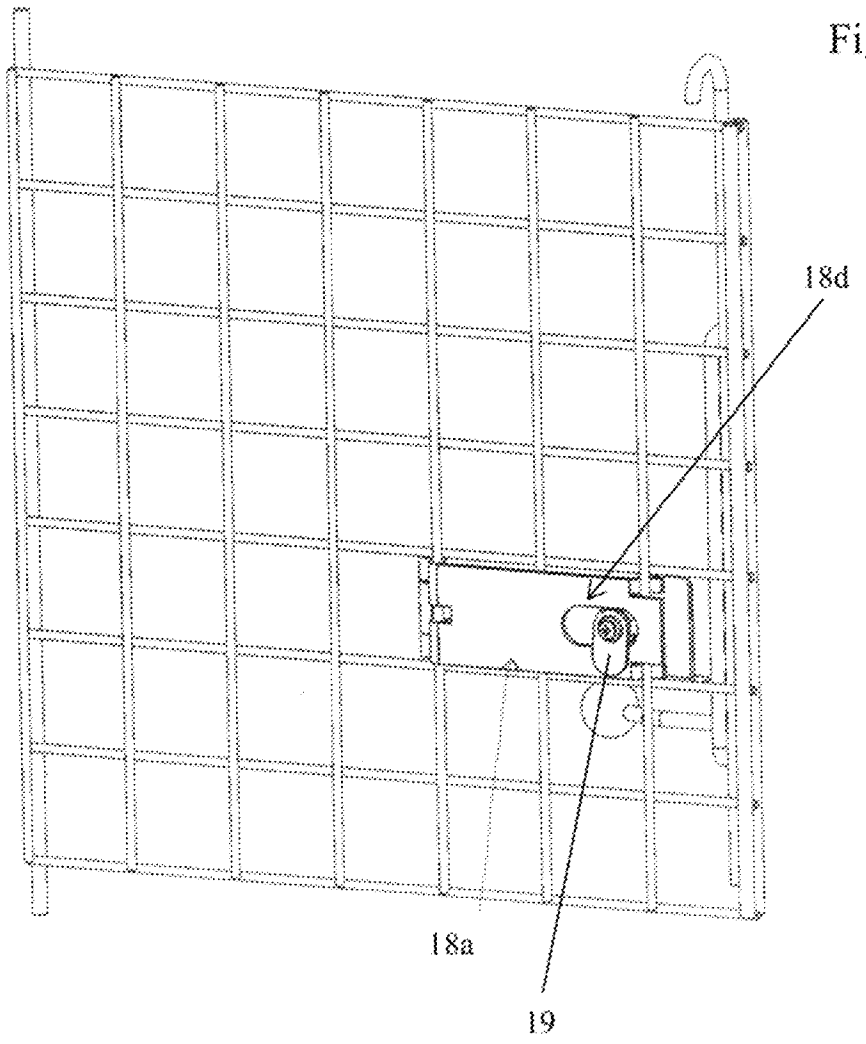
FIG. 18 is a back perspective view of FIG. 17.

As shown in FIGS. 18-21, the lock 16 has a cam 19 as a latch element. The lock 16 has is a knob 22, as can be seen in FIG. 17, for actuating the cam 19. As can be seen in FIG. 18, the cam 19 is selectively latched behind first bracket portion 18*a*. Alternatively, the cam 19 can also latch behind a section of door 14, for example as shown with respect to the embodiment shown in FIG. 15.

Figure 19:
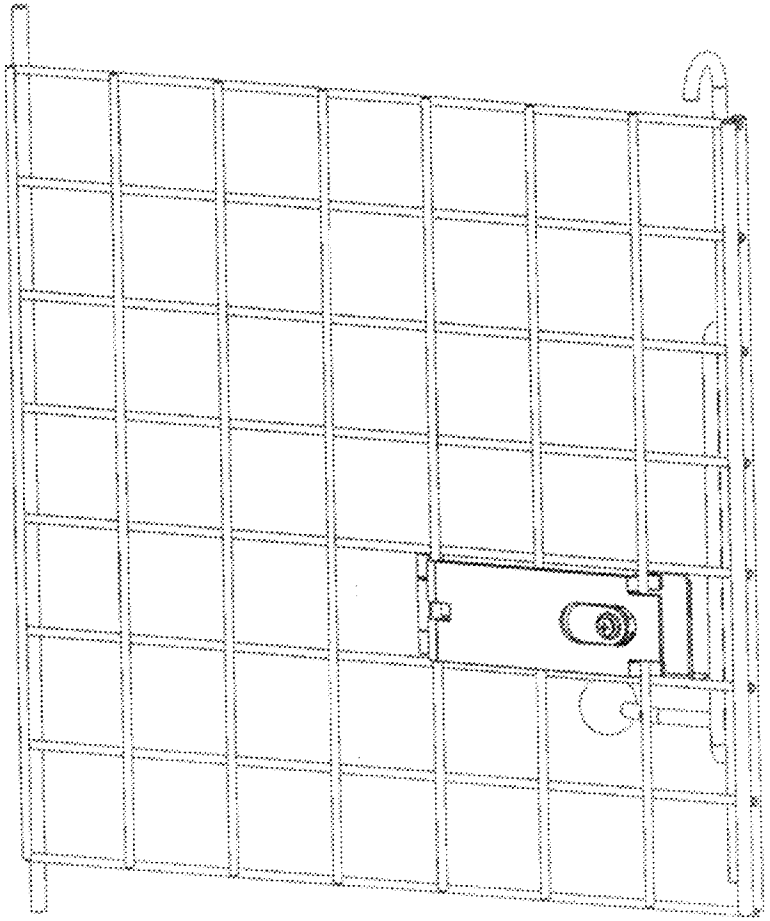
FIG. 19 is a back perspective view of the third embodiment illustrating the lock in an unlocked position.

The first mounting bracket 18*a* includes a latch opening 18*d*, which is approximately equal or slightly larger in size and shape to the cam 19 as shown in FIG. 19. The latch opening 18*d* is located in first mounting bracket 18*a* such that it aligns with the earn 19 when the second bracket portion 18*b* is in a closed position (as in FIG. 17). As such, when the cam 19 is in its unlatched position as in FIGS. 19-21, it will extend into and through the opening 18*d* in the first bracket portion 18*a* when the door 14 is closed.

Thereafter, when the knob 22 is rotated, the free end of the cam 19 will rotate behind and abut an area of the first bracket portion 18*a* about a side edge of the opening 18*d*, thereby securing the lock 16, second bracket portion 18*b* and plate 18*c* to the door, as illustrated in FIG. 18. It should be understood that the opening 18*d* can take any suitable size and shape which will allow a latch of any size and shape to pass therethrough in an unlatched position, and to engage the first bracket portion 18*a* in a latched position. It should also be understood that a suitably sized and shaped opening is formed in the second bracket portion 18*b* to allow the cam shaft attached to the knob 22 to pass therethrough when the base of the lock 16 is mounted on the second bracket portion 18*b*.

In FIG. 17 the lock 16 is in the closed position, and in FIGS. 20 and 21 the lock 16 is in the open position. In FIGS. 19-21, the cam 19 is in the unlatched position allowing the lock 16, the second bracket portion 18*b* and plate 18*c* to pivot to the open position in FIGS. 20-21, thereby allowing the handle 17 to be lifted to unlatch latch 15, as shown in FIG. 21, to allow the door 14 to swing open.

In this manner, the bracket 18 is designed to swing on hinge 20 to selectively allow the handle 17 to latch and unlatch to the door 14 via latch 15. When the lock 16 is latched to the first bracket portion 18*a* on the door 14, the plate 18*c* will block the vertical movement of handle 17. When the lock 16 is unlatched to the first bracket portion 18*a*, the second bracket portion 18*b*, plate 18*c* and lock 16 can swing away from the handle 17 so the plate 18*c* will no longer block the vertical movement of handle 17. Handle 17 can then be lifted to lift latch 15 as shown in FIG. 21, and the door 14 can be swung open. To relock, the door 14 is closed, the handle 17 is lowered to latch the door via latch 15, and the lock 16 is swung back to the closed position and latched via cam 19 in place so plate 18*c* is again blocking the handle 17 from vertical movement.

In a fourth embodiment shown in FIGS. 22-26, door 14, handle 17 and latch 15 are the same as in the third embodiment. The lock 30 has a spring-biased bolt 32 controlled by pressing a button 34 or similar actuating device to unlatch the lock 30 from a first bracket portion 36*a* of a mounting bracket 36. One of the advantages of the spring-biased bolt 32 over a cam controlled by rotating a knob is for re-latching. A latch portion 33 of the bolt 32 will be biased to the latched position by the spring (not shown), and will automatically latch into place when the lock 30 is closed, eliminating the need to rotate a knob back to the latched position as shown in the prior embodiments in FIGS. 1-21.

Figure 24:
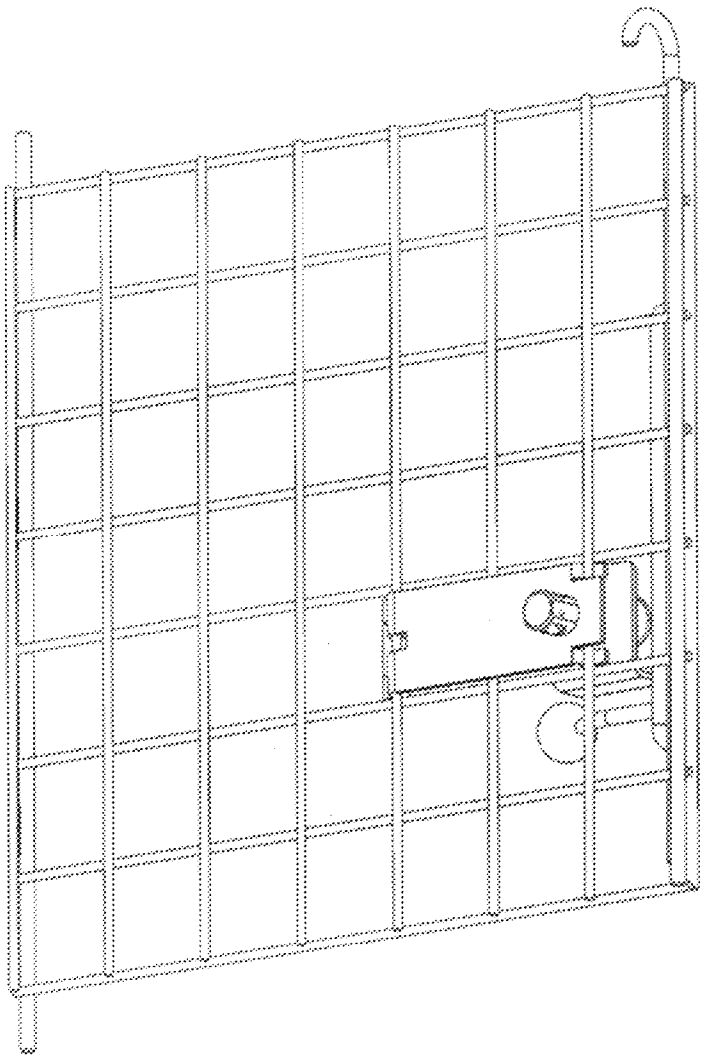
FIG. 24 is a back perspective view of the fourth embodiment illustrating the lock in an unlocked position.

The first bracket portion 36*a* includes a bolt opening 36*d* which is approximately equal or slightly larger in size and shape to the bolt 32 as shown in FIG. 24. The bolt opening 36*d* is located in first bracket portion 36*a* such that it aligns with the bolt 32 when the second bracket portion 36*b* is in a closed position (as in FIG. 22). As such, the bolt 32 will extend into and through the opening 36*d* in the first bracket portion 36*a*, and automatically latch by spring action, thereby securing the lock 30, second bracket portion 36*b* and strike plate 36*c* to the door 14.

The latch portion 33 of the bolt 32 is normally in its extended position from the bias of the spring. As the second bracket portion 36*b* is moved to the closed position, the latch portion 33 of the bolt will contact the edge of bolt opening 36*d* and become pushed into the bolt 32 against the bias of the internal spring (not shown). Once the latch portion 33 completely clears the bolt opening 36*d*, the latch portion 33 will move back to its extended position, shown in FIG. 23, from the bias of the spring, and thereby latch the lock 30.

Figure 22:
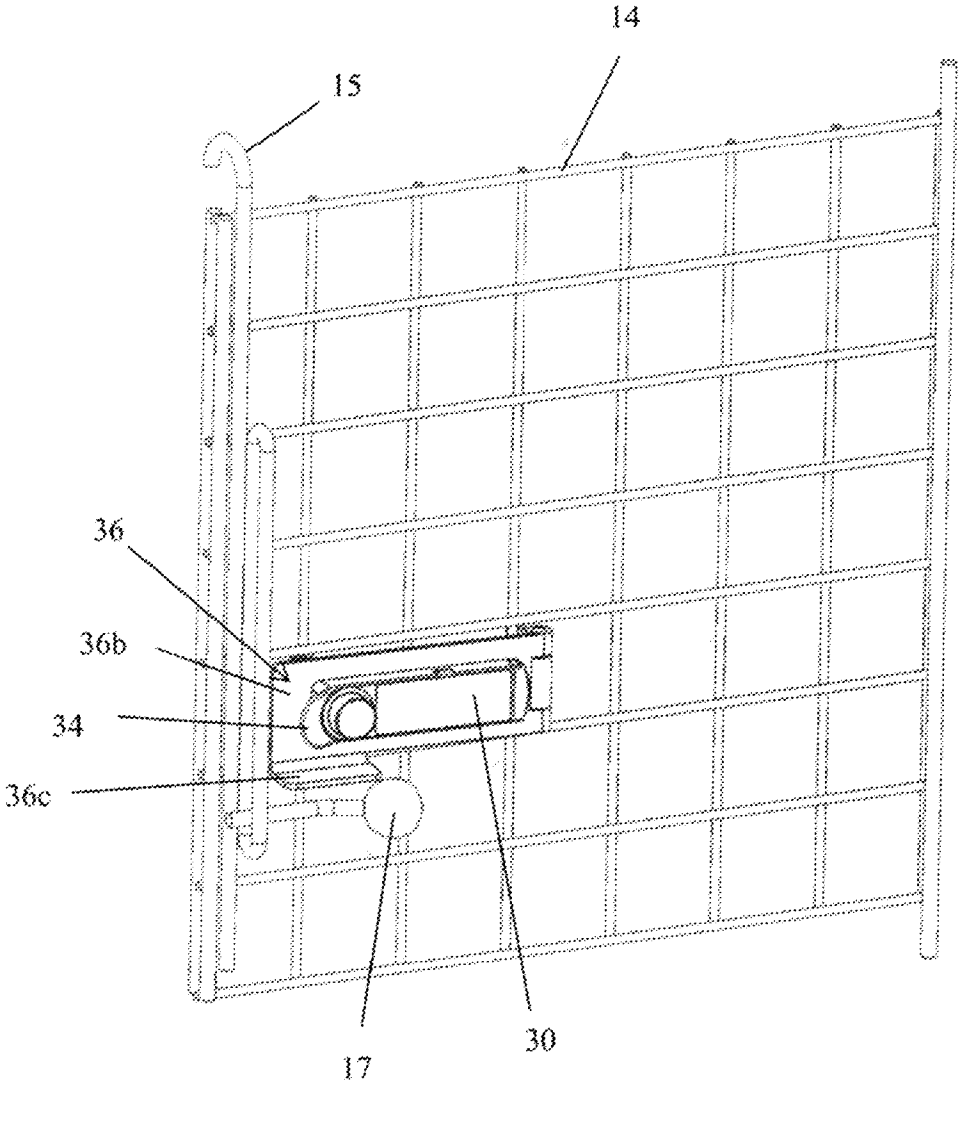
FIG. 22 is a front perspective view of a fourth embodiment of a lock for use in connection with a storage box with a single wire cage door, and illustrating the single wire cage door with the lock bracket closed and the lock in a locked position.
Figure 23:
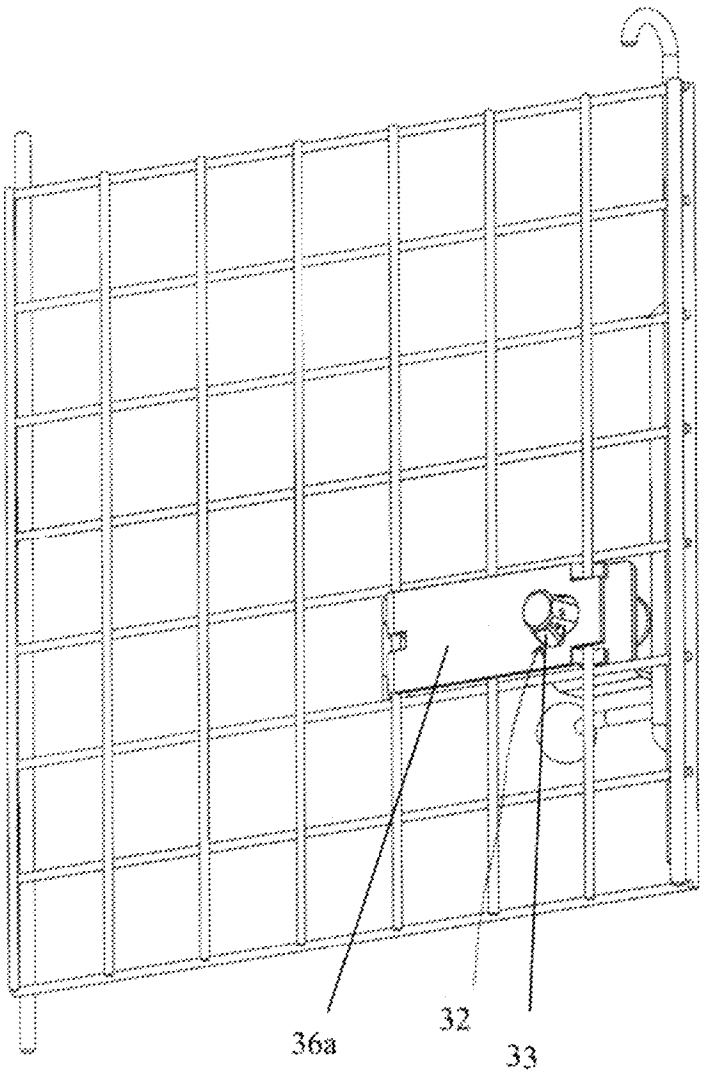
FIG. 23 is a back perspective view of FIG. 17.

In FIGS. 22 and 23 the lock 30 is in its closed positioned and locked, and the bolt 32 is in the latched position, with latch portion 33 extended. In this position, the second bracket 36*b*, lock 30 and strike plate 36*c* are prevented from moving to the opened position, thus preventing the handle 17 from being lifted, so the door 14 remains closed and latched.

Figure 25:
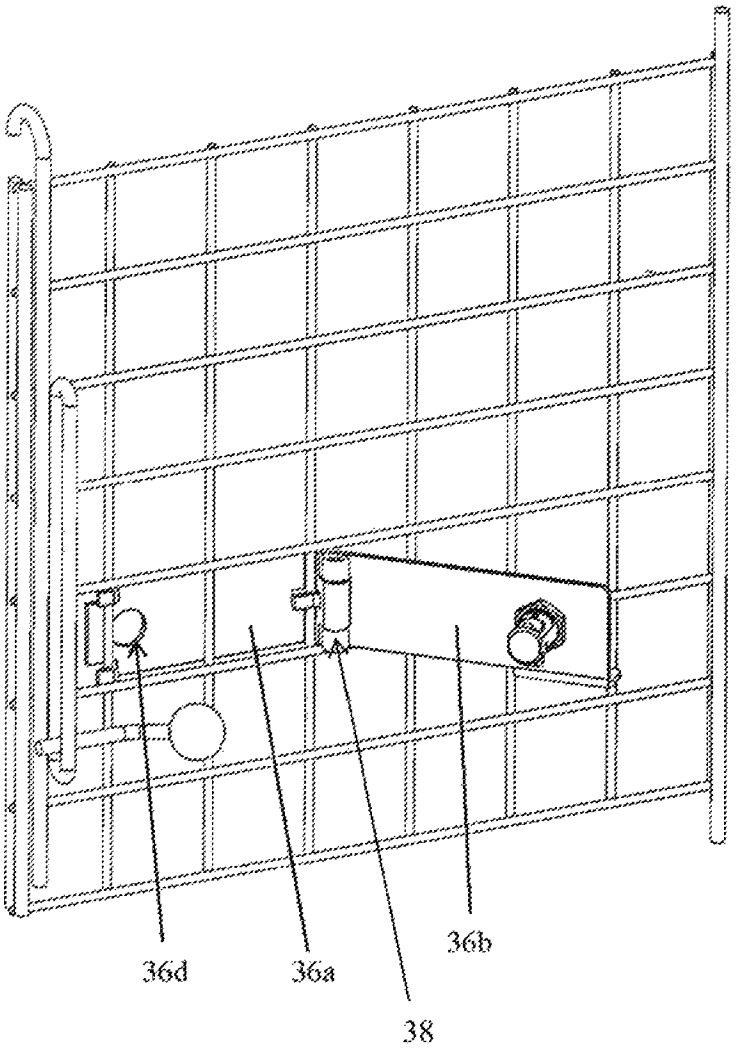
FIG. 25 is a front perspective view of the fourth embodiment illustrating the lock bracket opened and the door latch in a locked position.
Figure 26:
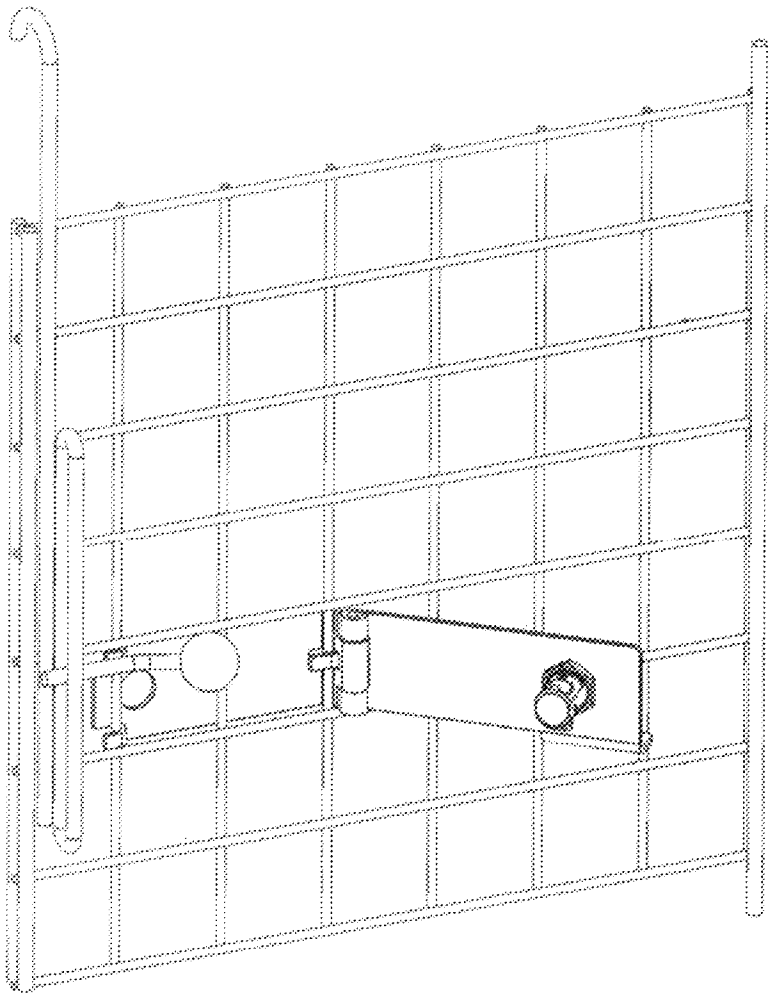
FIG. 26 is a front perspective view of the fourth embodiment illustrating the lock bracket opened and the door latch in an unlocked position.

In FIG. 24, the lock 30 is accessed, the button 34 is pressed, and the latch portion 33 of bolt 32 is withdrawn, whereupon the lock 30 can be swung to its open position as shown in FIG. 25. Pressing the button 34 will cause the latch portion 33 to retract mechanically against the bias of its spring. When the button 34 is released, the latch portion 33 will extend via the spring bias to its latch position. Once the lock 30 is in its open position, the handle 17 can be lifted to unlatched latch 15 as shown in FIG. 26, so the door 14 can be opened.

To re-lock the lock 30, the second bracket portion 36*b* is swung from the open position in FIG. 25, about hinge 38, to the closed position in FIGS. 22 and 23. The spring-biased bolt 32 will allow the lock 30 to latch behind first bracket portion 36*a* by the pushing action of the spring, as discussed above, and no turning of a knob is required to re-latch and lock. If desired, the spring-biased holt 32 of this embodiment can be substituted into the prior embodiments of FIGS. 1-21 if one wants to eliminate the need to turn the knob to re-latch with the rotating latch.

Figure 27:
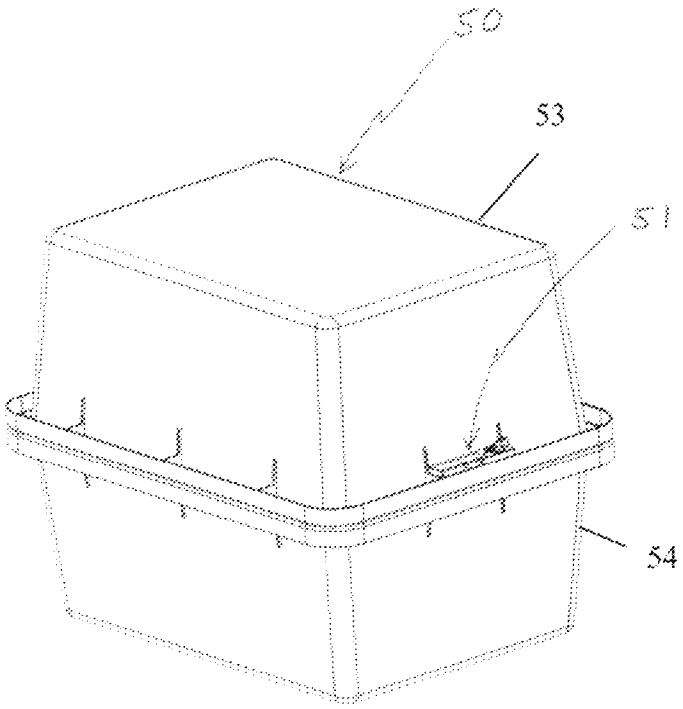
FIG. 27 is a perspective view of a fifth embodiment of a lock for a storage bin with a lid, and illustrating the lid seated on the bin with the lock in a locked position.
Figure 28:
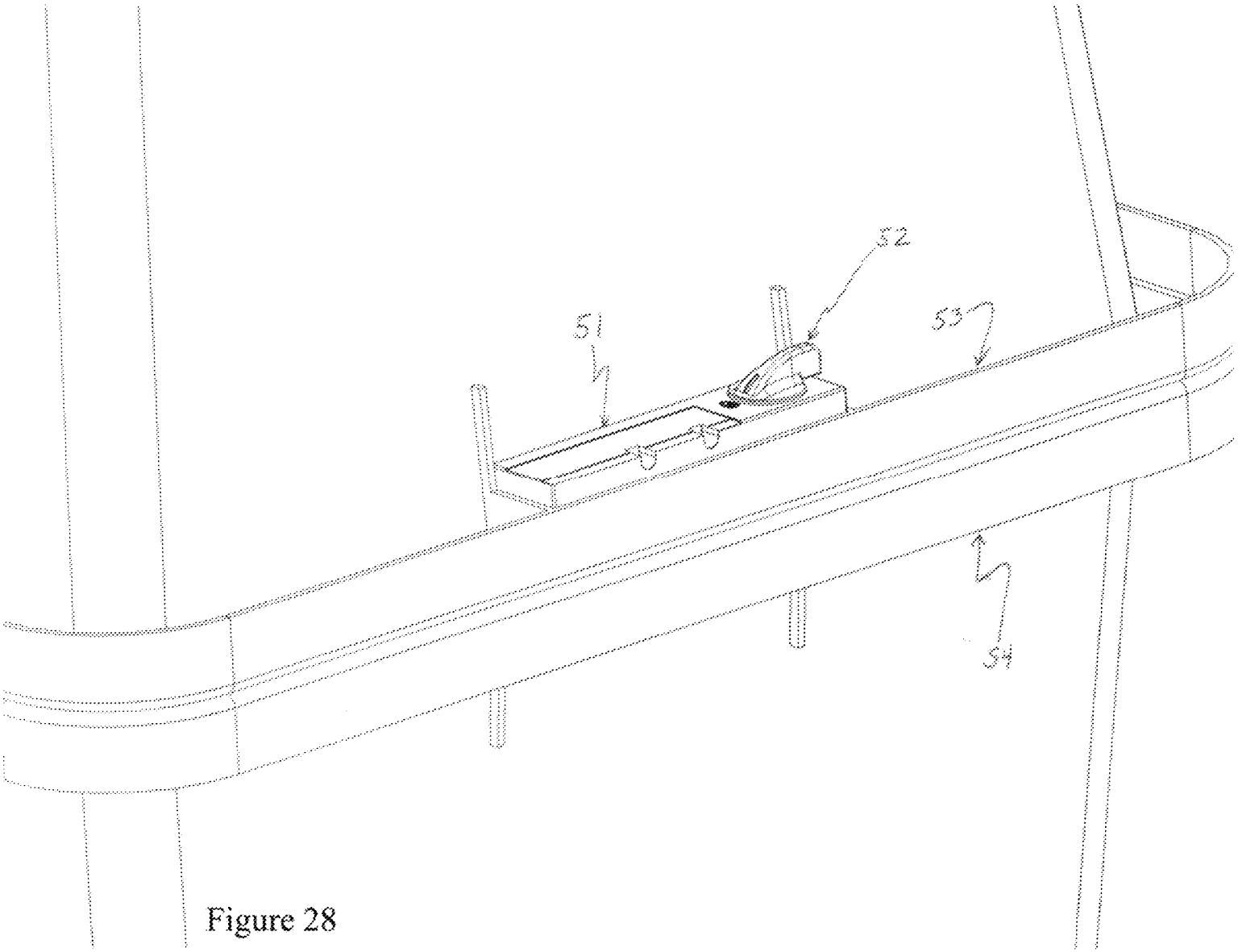
FIG. 28 is a partial enlarged front perspective view of FIG. 27.

A fifth embodiment comprising a magnetically controlled lock system for a storage bin with a lid is shown in FIGS. 27-36. A perspective view of the fifth embodiment is shown in FIG. 27, illustrating a bin lid or cover 53 seated on a bin base 54 of storage bin 50 with the magnetically controlled lock 51 in a locked position. An enlarged perspective view of the lock 51 in FIG. 27 is shown in FIG. 28. As illustrated in FIG. 28, a knob 52 of the lock 51 is in its locked position to hold the bin cover 53 to bin base 54, in a similar manner as described with respect to the first embodiment of FIGS. 1-12. However, this fifth embodiment differs in structure and function from the first embodiment in that the lock 51 is controlled by a magnetic key, as discussed below.

Figure 29:
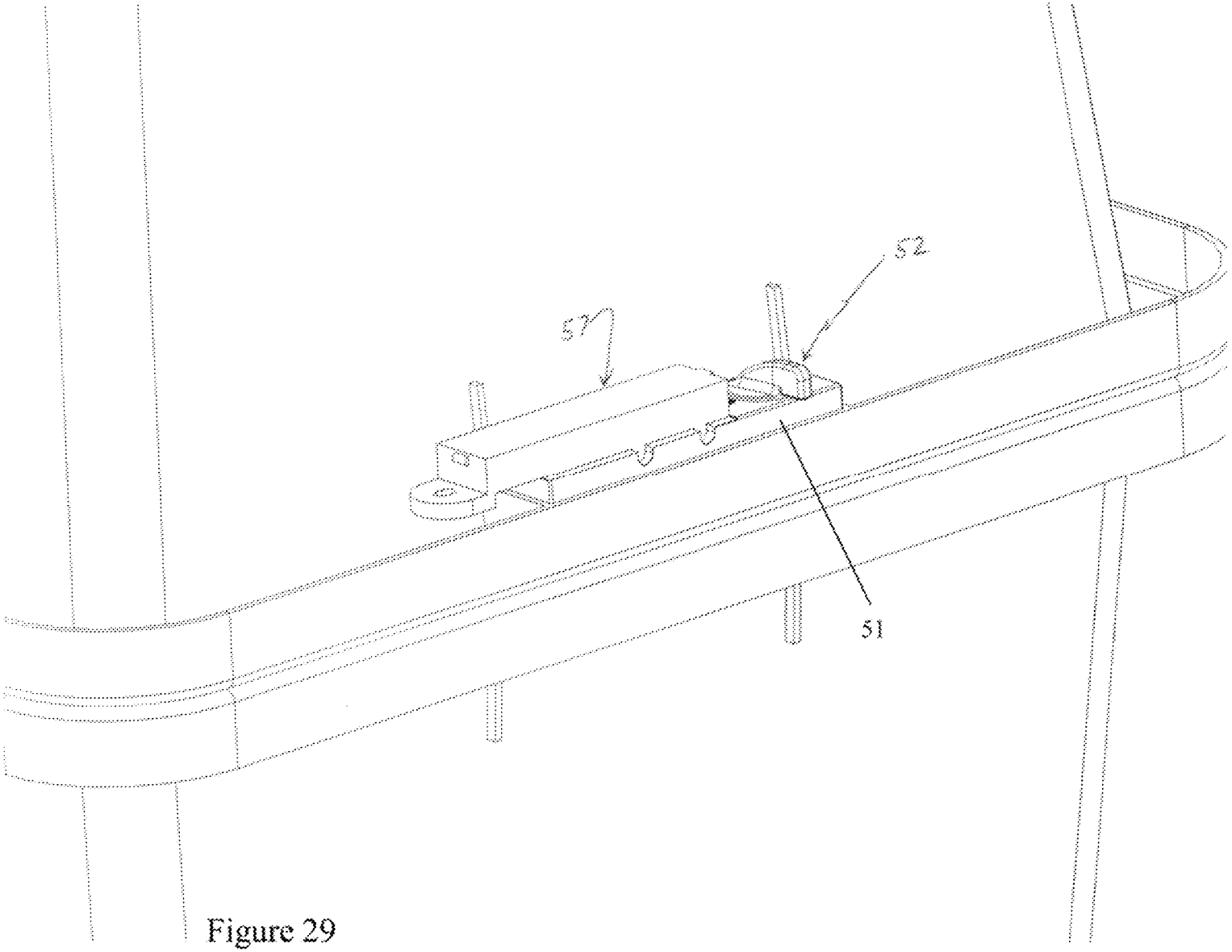
FIG. 29 is a partial enlarged front perspective view of the fifth embodiment and illustrating the placement and use of a magnetic key and the lock in an unlocked position.
Figure 30:
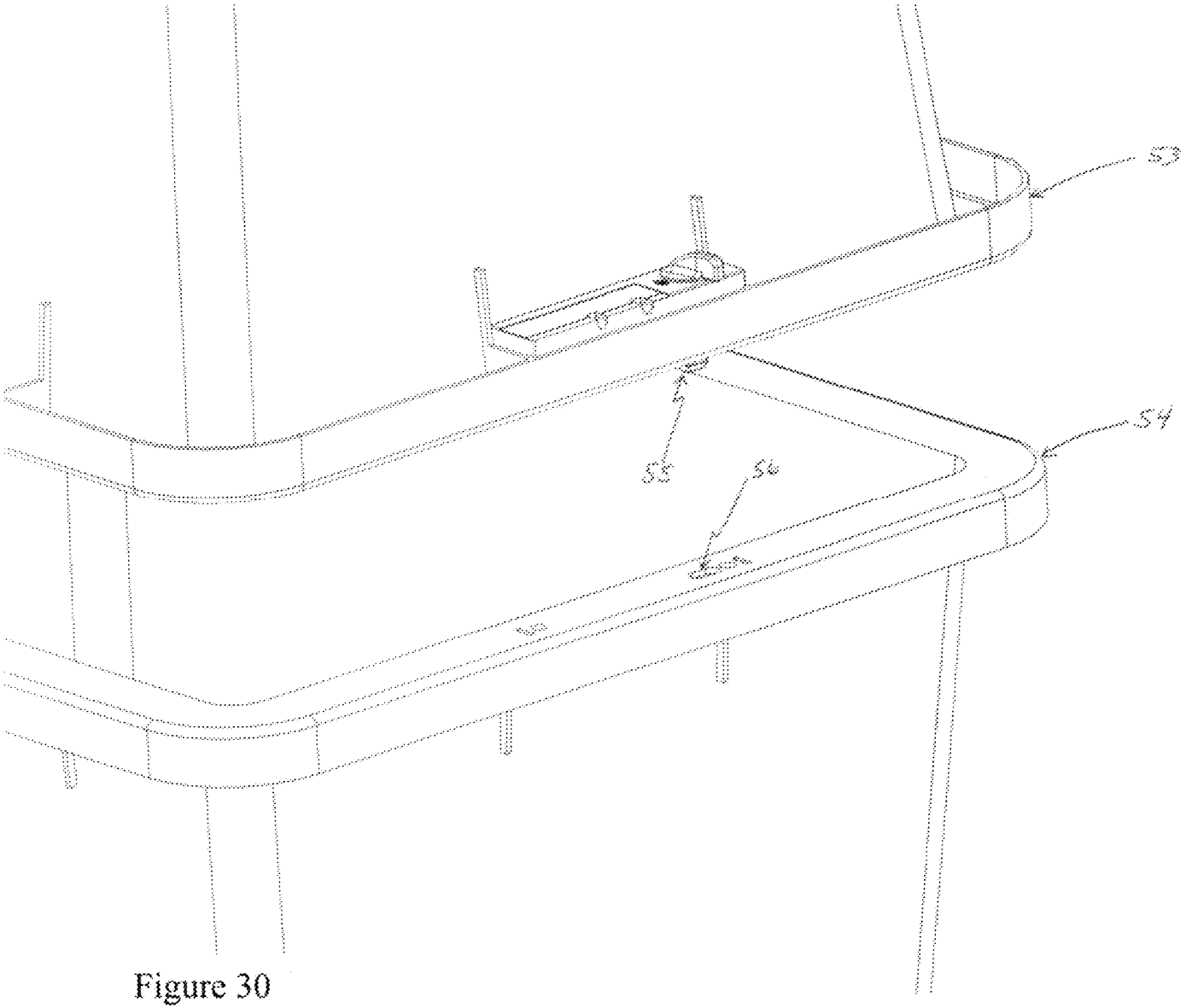
FIG. 30 is a partial enlarged perspective view of the fifth embodiment, and illustrating the lid spaced from the bin with the lock in an unlocked position.

FIG. 29 shows an enlarged perspective view of the lock 51 with knob 52 having been moved to its unlocked position after a magnetic key 57 is applied to the lock 51. As shown in FIG. 30, once the magnetic key 57 has been applied to the lock 51 and the knob 52 turned to its unlocked position, the bin cover 53 can be separated from bin base 54 as T-shaped latch or bayonet 55 can be released from the slot 56 formed in a rim of bin base 54 in a similar manner as discussed with respect to the first embodiment.

Figure 31:
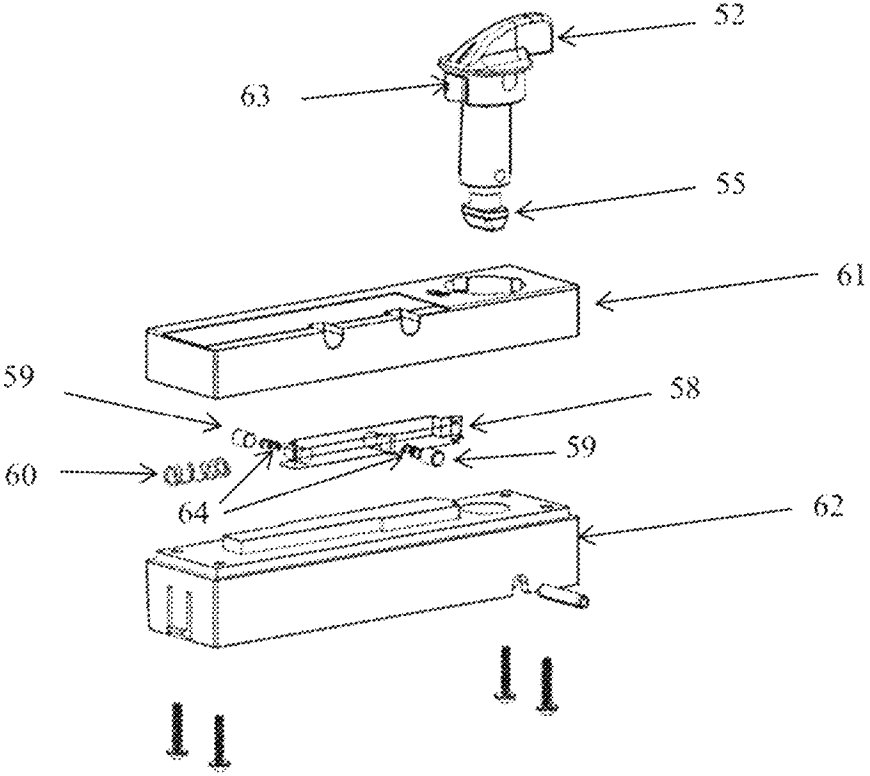
FIG. 31 is an exploded perspective view of the lock of the fifth embodiment.
Figure 32:
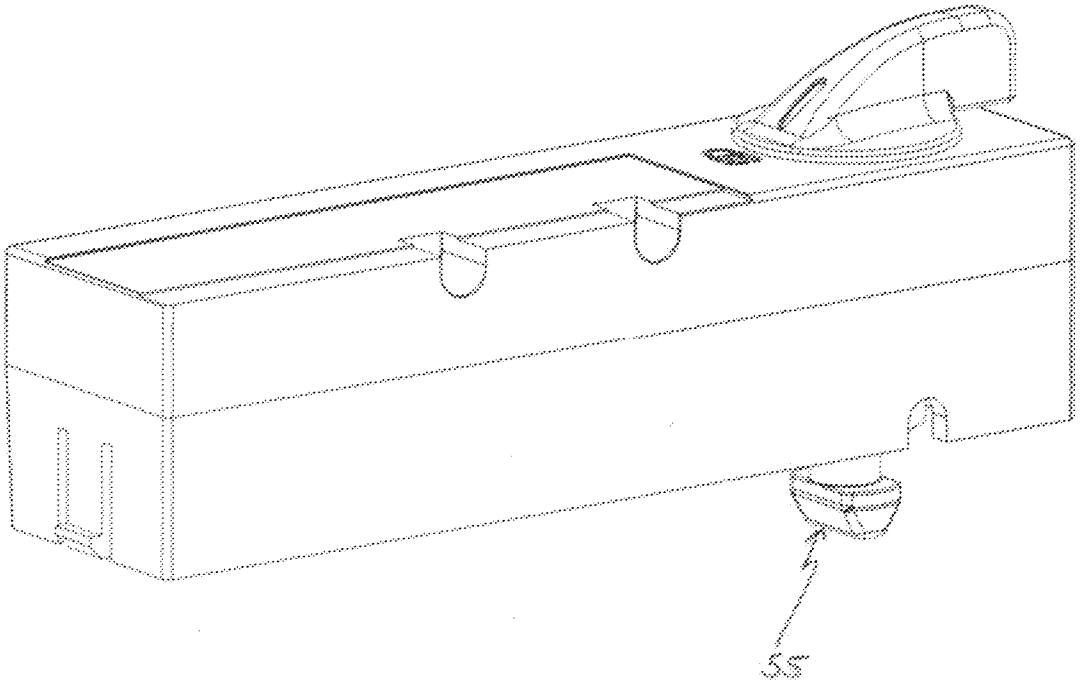
FIG. 32 is a perspective view of the lock of the fifth embodiment in locked position.

FIGS. 31 and 32 shows the lock 51 with bayonet 55 in the locked position. FIG. 31 is an exploded perspective view of the lock 51, while FIG. 32 is an unexploded perspective view of the lock 51. As can be seen in FIG. 31, the lock 51 has a lock cover 61 and a lock base 62 and comprises a knob 52 which actuates the T-shaped latch or bayonet 55, and a knob latch 58 having spring-biased magnets 59 and a latch spring 60. The knob 52 has a knob slot 63 (shown in FIGS. 33, 35 and 36) for engagement with knob latch 58 as discussed below.

Figure 33:
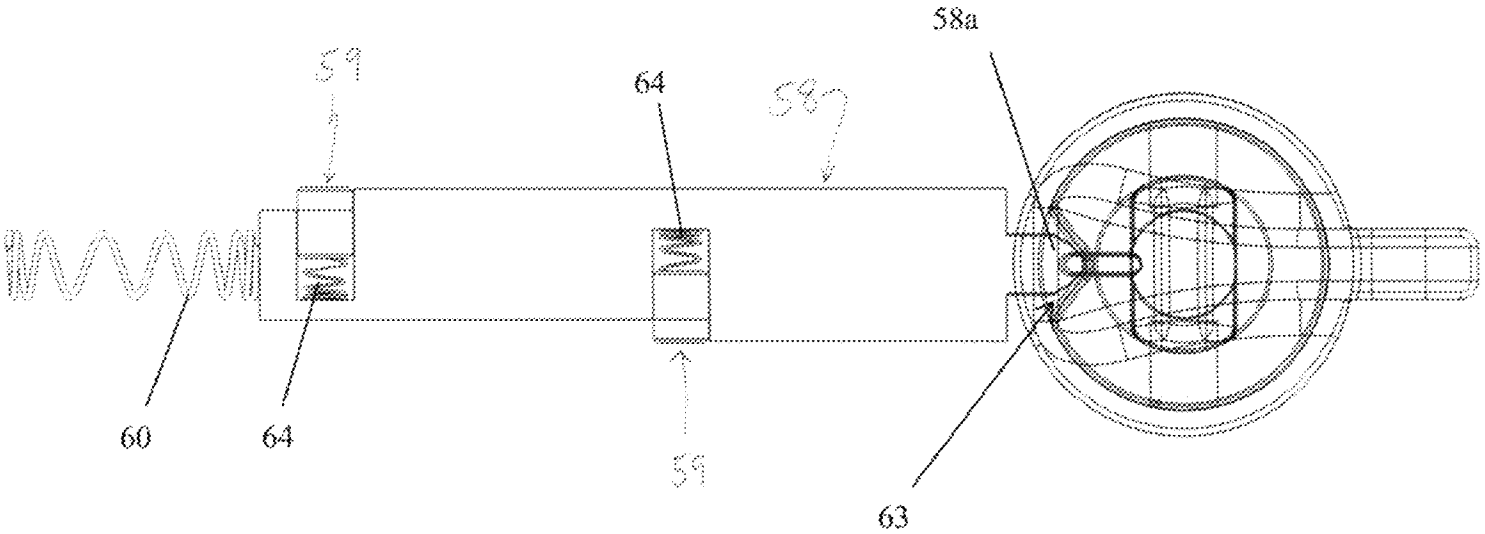
FIG. 33 is a partial phantom top view of the latching mechanism and lock latch of the fifth embodiment in locked position, and illustrating the latching mechanism extended to prevent movement of the lock latch from its locked position.

As best seen in FIG. 33, latch spring 60 biases the tip 58*a* of knob latch 58 into the knob slot 63 to its locked position. Latch 58 has at least, one magnet, preferably two magnets 59 as shown attached to it on opposite sides. The magnets 59 are biased by springs 64 to extend into or engage slots, steps or profiles formed in the cover 61 to keep latch 58 stationary, in the same or a similar manner as discussed below with respect to the embodiment of FIG. 52. The magnets align with and engage the slots, steps or profiles of cover 61 when the latch spring 60 biases the tip 58*a* of knob latch 58 into the knob slot 63. In this position, the tip 58*a* of the knob latch 58 extends into the knob slot 63 such that the knob 52 cannot be turned when the magnets 59 engage the slots, steps or profiles formed in the cover 61, thereby preventing the knob latch 58 from moving out of slot 63. A magnetic key 57 is required to disengage the magnets 59 from the slots, steps or profiles in cover 61, thereby allowing the knob latch 58 to move out of knob slot 63 when knob 52 is turned as shown and described in FIGS. 33-36.

The magnetic key 57 comprises a corresponding number of magnets as latch 58 has. The lock 51 may be configured to either have two magnets (requiring the magnetic key to have two magnets positioned accordingly) or simply a single magnet. The two magnet lock may be more secure since lining up two magnets to unlock is more challenging than using a single magnet. The polarity of the magnets (north or south) may be varied in order to require the key to have its magnets positioned in an opposing or equal polarity for unlocking. The use of more than two magnets is possible as well.

FIG. 33 shows the latch 58 in the locked position, wherein latch 58 is biased into the knob slot 63 by spring 60, and magnets 59 are biased out by springs 64 and interfering with inner profiles or steps of cover 61 (cover 61 not shown in the view). In this manner, latch 58 cannot move.

Figure 34:
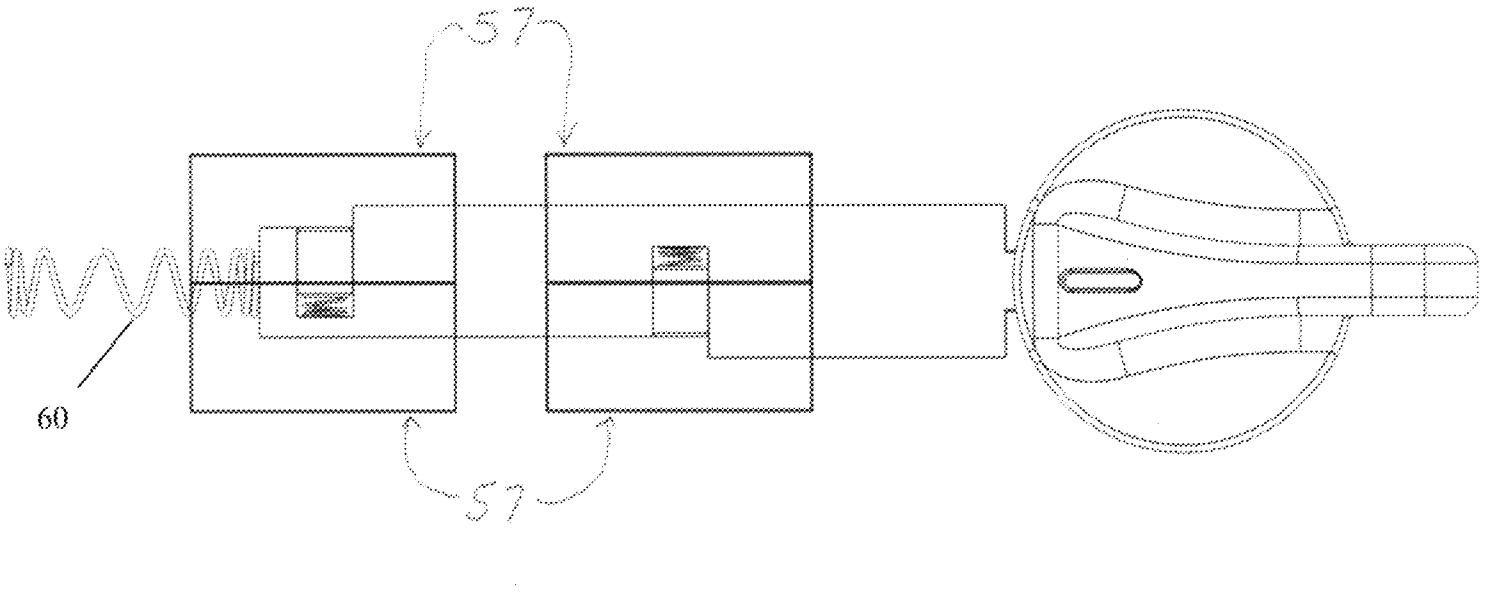
FIG. 34 is a top view of the latching mechanism and lock latch of the fifth embodiment in locked position, and illustrating schematically the placement and use of a magnetic key to live the latching mechanism.

FIG. 34 shows magnetic key 57 having two key magnets positioned over lock 51 so that the key magnets (in this ease two or more magnets) are located proximate the lock magnets 59 and interact with the lock magnets 59 to pull (or alternatively push depending on the location and polarity) the lock magnets 59 inward against the springs 64 to eliminate the interference with cover 61 and unlock the latch 58. Once unlocked, latch 58 can move out of knob slot 63 when forced back against the spring 60.

Figure 35:
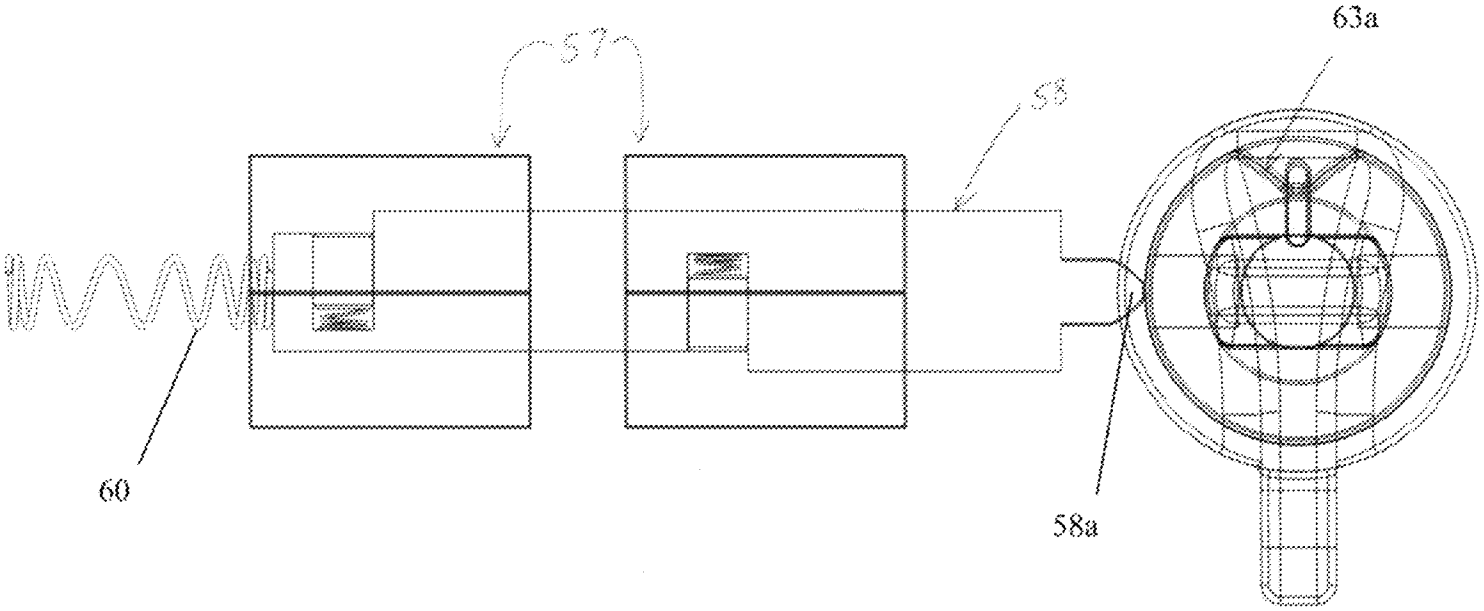
FIG. 35 is a partial phantom top view of the latching mechanism and lock latch of the fifth embodiment in unlocked position, and illustrating the latching mechanism retracted to allow movement of the lock latch to its unlocked position.

FIG. 35 shows the knob 52 having been moved to its unlocked position. With the key magnets and lock magnets 59 properly aligned, and the magnets 59 thereby retracted, as the knob 52 is turned, the latch 58 will move against the spring force (to the left as illustrated) out of interference with the knob slot 63 due to the angled surfaces of slot 63 applying a force to the tip of latch 58. Thus, as knob 52 is turned, the tip 58*a* of latch 58 rides along the angled surface 63*a* of slot 63 and is pushed back against the spring force until it exits the slot 63 completely, and thereafter contacts a side surface of the knob 52 as shown in FIG. 35. This is the unlatched position of latch 58.

Figure 36:
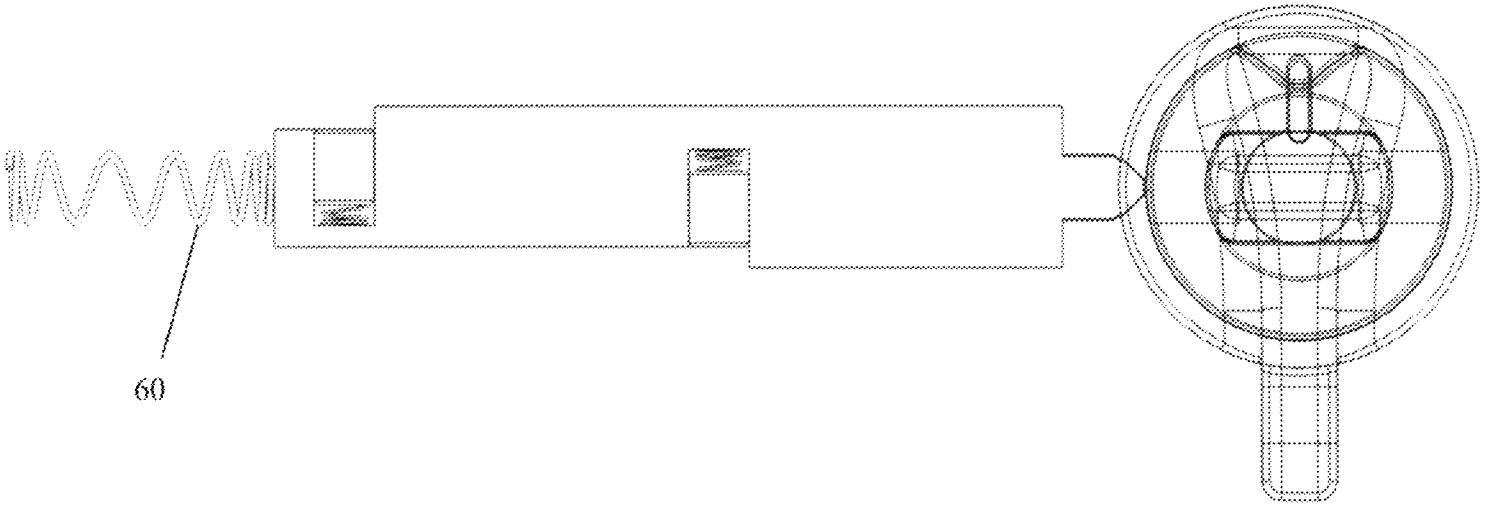
FIG. 36 is a partial phantom top view of the latching mechanism and lock latch of the fifth embodiment in unlocked position, and illustrating the latching mechanism remaining retracted after removal of the magnetic key when the lock is in its unlocked position.

When the magnetic key 57 is removed from the lock as illustrated in FIG. 36, latch 58 remains in its unlatched position as the tip of the latch 58 is in contact with the side surface of the knob 52. As the knob 52 is turned back to its lock position, the tip 58*a* of latch 58 will slide along the side surface of the knob 52 until it reaches the knob slot 63. At that time, the tip 58*a* of the latch 58 will begin to slide down the angled surface 63*a* of slot 63 and into slot 63 as the spring 60 pushes the latch 58 into the slot 63. Once the tip 58*a* of the latch 58 fully enters the slot 63, the lock magnets 50 will align with and engage the slots or profiles in the lock cover 61 to hold the latch 58 in its latched position, where it will stay until the magnetic key is properly positioned and the knob 52 turned.

Figure 37:
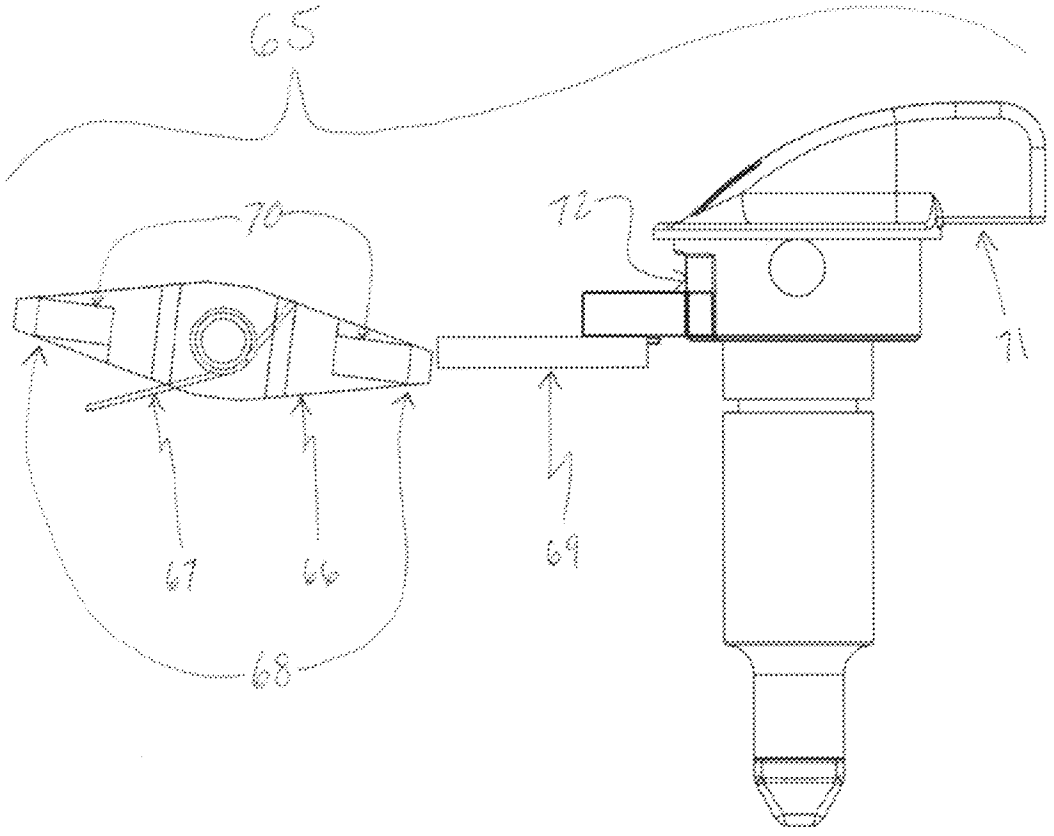
FIG. 37 is a side view of a latching mechanism and lock latch of a sixth embodiment in locked position, and illustrating a latching mechanism extended to prevent movement of the lock latch from its locked position.
Figure 38:
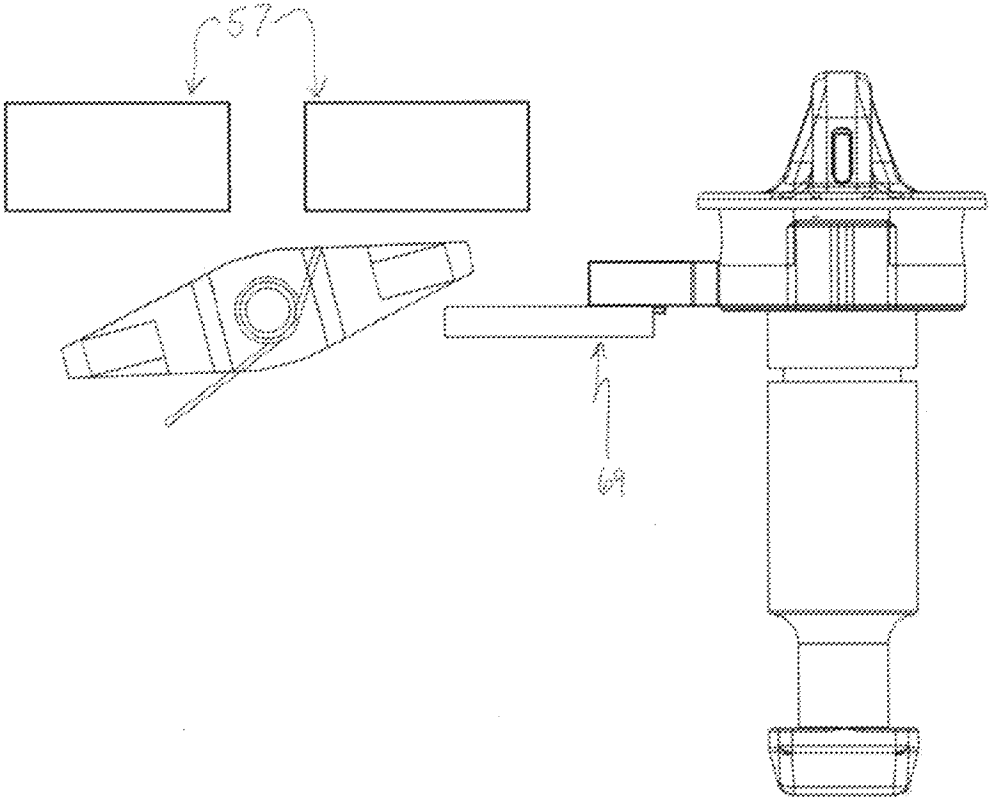
FIG. 38 is a side view of the latching mechanism and lock latch of the sixth embodiment in unlocked position, and illustrating schematically the placement and use of a magnetic key to free the latching mechanism.

A sixth embodiment for a magnetically controlled hock system for a storage bin with a lid is shown in FIGS. 37 and 38. This sixth embodiment, is the same as the fifth embodiment of FIGS. 27-36, except in the sixth embodiment, an alternate magnetic latch system 65 is used in place of the knob latch 58 of the fifth embodiment.

FIG. 37 is a side view of the alternate latch system 65 in a locked position. A toggle 66 is biased by spring 67 to its locked position, interfering with movement of a latch 69, and holding the latch 69 in its locked position extending into a knob slot 72 of knob 71. Latch 69 is biased by a spring (not shown) into the slot 72 of knob 71, in a similar manner as the fifth embodiment. Toggle 66 is connected to two magnets 70, having no effect when the magnetic key is not being used.

As illustrated in FIG. 38, when the magnetic key 57 is positioned above toggle 66, the magnets in the magnetic key 57 (if in the correct polarity and if powerful enough) will interact with toggle magnets 70 by pushing/pulling toggle 66 to pivot in the opposite direction of FIG. 37 (counterclockwise as illustrated) against the force of spring 67. At this point, toggle 66 is no longer interfering with latch 69. After the magnetic key 57 has moved the toggle 66, when knob 71 is rotated to its on locked position as shown, an angled surface of slot 72 forces latch 69 against the bias of its spring (to the left as illustrated) in a similar manner as the fifth embodiment, and the unit is unlocked. Once unlocked, the lid can be separated from the base of the storage bin.

A seventh embodiment for a magnetically controlled lock system for a storage bin with two swinging hinged covers is shown in FIGS. 39-42. The lock 77 of the seventh embodiment is the same as either the fifth embodiment or sixth embodiment, except with respect to where it latches to the bin 70 as described below.

Figure 39:
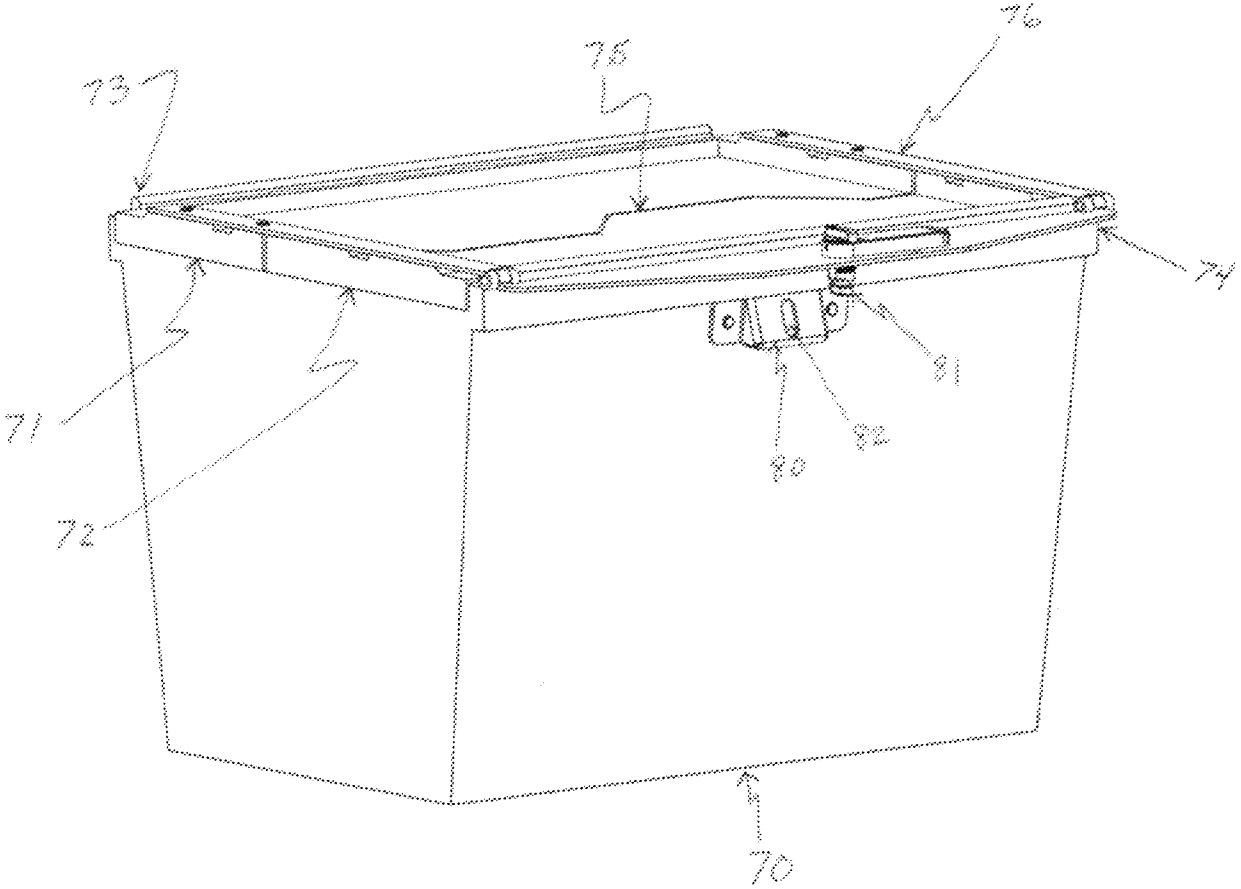
FIG. 39 is a perspective view of a seventh embodiment of a lock for a storage bin with two swinging hinged covers, and illustrating the covers closed and a pivotable lock plate opened with the lock in an unlocked position.
Figure 40:
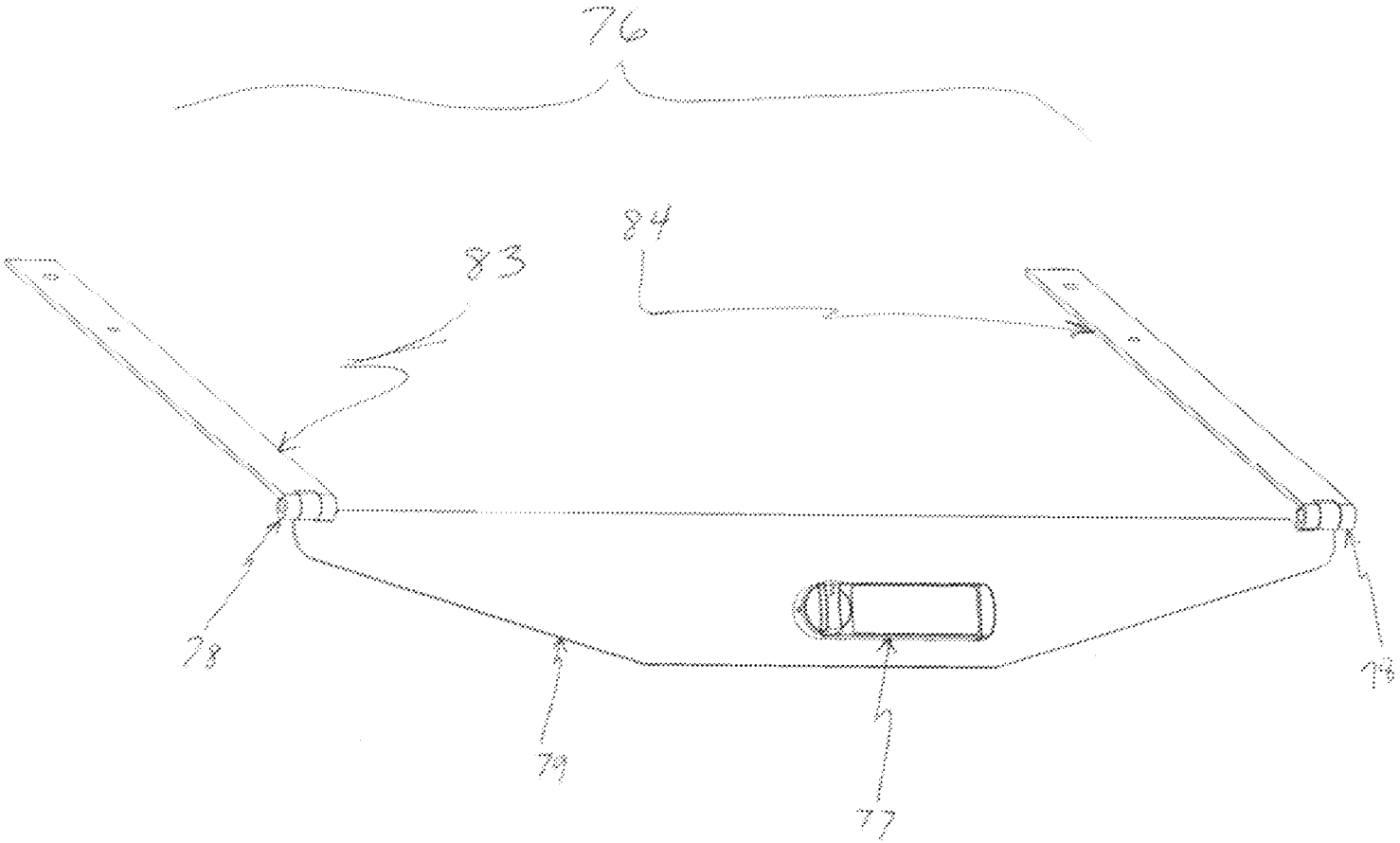
FIG. 40 is an enlarged perspective view of the lock bracket of FIG. 39.

In FIG. 39, a storage bin 70 having two swinging hinged covers 71 and 72 attached to the bin via hinges 73 and 74, respectively, is illustrated. When in their closed position, the covers 71 and 72 are swung over on top of the bin 70 and meet/interlock in the center at 75. A lock bracket 76, best seen in FIG. 40, is attached to one of the covers, e.g., cover 71 as shown. The bracket 76 comprises two arms 83 and 84. One end of each arm is attached to cover 71. The other ends of each arm are pivotally attached to a plate 79 via hinges 78. Lock 77 is mounted on plate 79 with its T-shaped latch or bayonet 81 extending therethough. A bracket 80 having a slot 82 is mounted on bin 70 in a position to align slot 82 and bayonet 81 so that the bayonet can pass through slot 82 in its unlocked position, and then when the knob of lock 77 is turned, the ends of the T-shaped latch or bayonet 81 rotate under and abut an area of the bracket 80 about the side edges of the slot 82 in its locked position.

Figure 41:
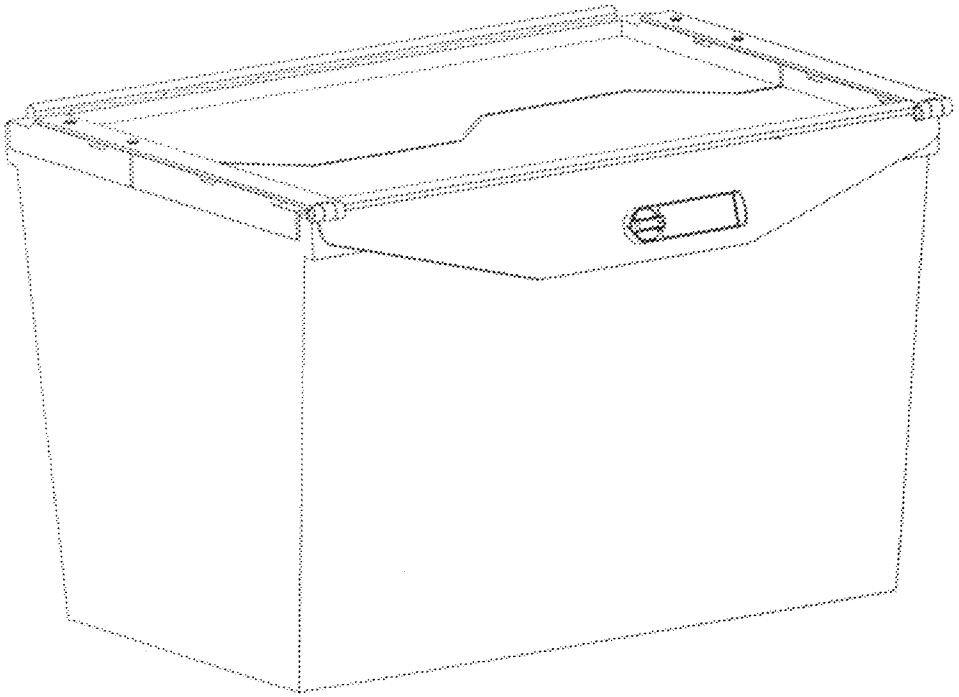
FIG. 41 is a perspective view of the seventh embodiment, and illustrating the covers closed and the pivotable lock plate closed with the lock in a locked position.
Figure 42:
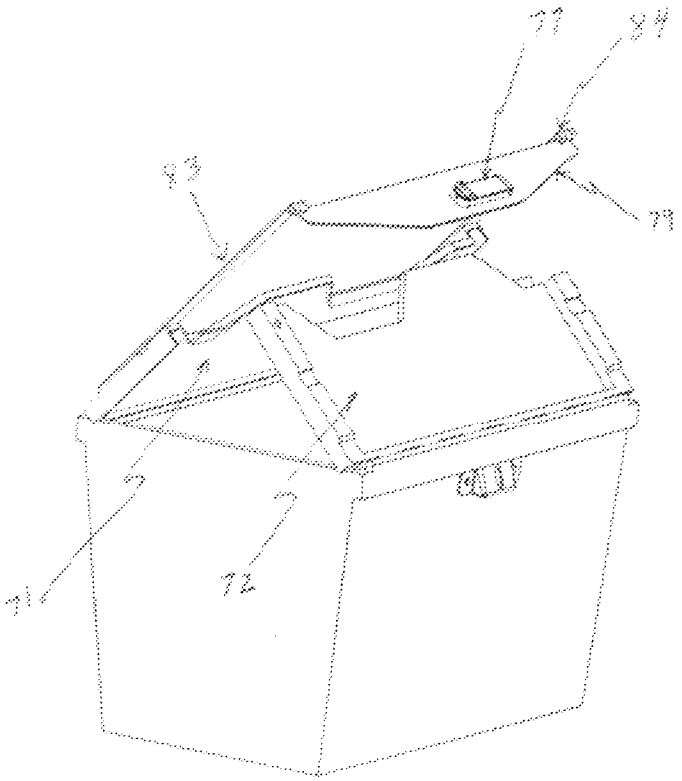
FIG. 42 is a perspective view of the seventh embodiment, and illustrating the covers opened and the lock in an unlocked position.

The arms 83 and 84 of bracket 76 lie over the top raised side edge surfaces of covers 71 and 72 of bin 70 as shown in FIGS. 39 and 41, and are attached by screws or other fasteners to cover 71. Preferably, the bracket 76, i.e., arms 83 and 84 and plate 79 are formed from a strong, thin sheet of material such as rigid metal or plastic sufficient to secure the lids closed when lock 51 is locked. The specific material can vary depending on how secure the bins need be and how much resistance to tampering or breakage is desired. Preferably, bracket 76 overlays only the top raised edge surface of the bin covers 71 and 72, as can be seen in FIGS. 39, 41 and 42, so that bracket 76 will not interfere with the stacking of bins on top of each other. When bins of the type illustrated in FIGS. 39, 41 and 42 are stacked, the top raised edge surface of a lower bin in a stack is not touched by the bottom portion of an adjacent, upper bin.

Plate 79 and lock 77 can swing about hinges 78 in and out of a latched position with bracket 80. FIG. 39 shows plate 79 and lock 77 swung away from bracket 80. FIG. 41 shows plate 79 and lock 77 swung to the latched position. Lock 77 can be the locks shown in the first, fifth or sixth embodiments, or can be an electronically controlled motorized lock mechanism as described in U.S. Patent Application Publication No. 2015/0252591 titled "Lock", published on Sep. 10, 2015, herein incorporated by reference.

When the bayonet 81 engages bracket 80 in the locked position, the arms 83 and 84 of lock bracket 76 overlie the covers 71 and 73, as shown in FIG. 41. In this example, the bin 70 is secured and covers 71 and 72 cannot be swung open. When the bayonet 81 disengages from bracket 80 with plate 79 swung away from bracket 80 to the unlocked position, the arms 83 and 84 of lock bracket 76 (attached to cover 71) are free to swing in an upward direction and separate from cover 72 so the contents of the bin 70 are exposed, as shown in FIG. 42.

FIGS. 43-52 illustrated an eighth embodiment comprising a magnetically controlled lock system with a rotor latch for locking a cage or bin with single or double swinging wire/cage door(s). In this embodiment, the lock is illustrated as a manually or electronically actuated kick mounted to a door of the cage or bin, and selectively engaging a strike or other area or portion of the cage or bin to secure the door(s) to the cage or bin. Use of this lock with storage containers and doors of any suitable size and shape are contemplated. Further, it should be understood that the lock of this embodiment can be used with any type of storage container and any type of door or lid or other closure device, wherein the lock can be integrated on a door or lid or other closure device for engagement with a strike on or another part of the storage container or a second door.

Figure 43:
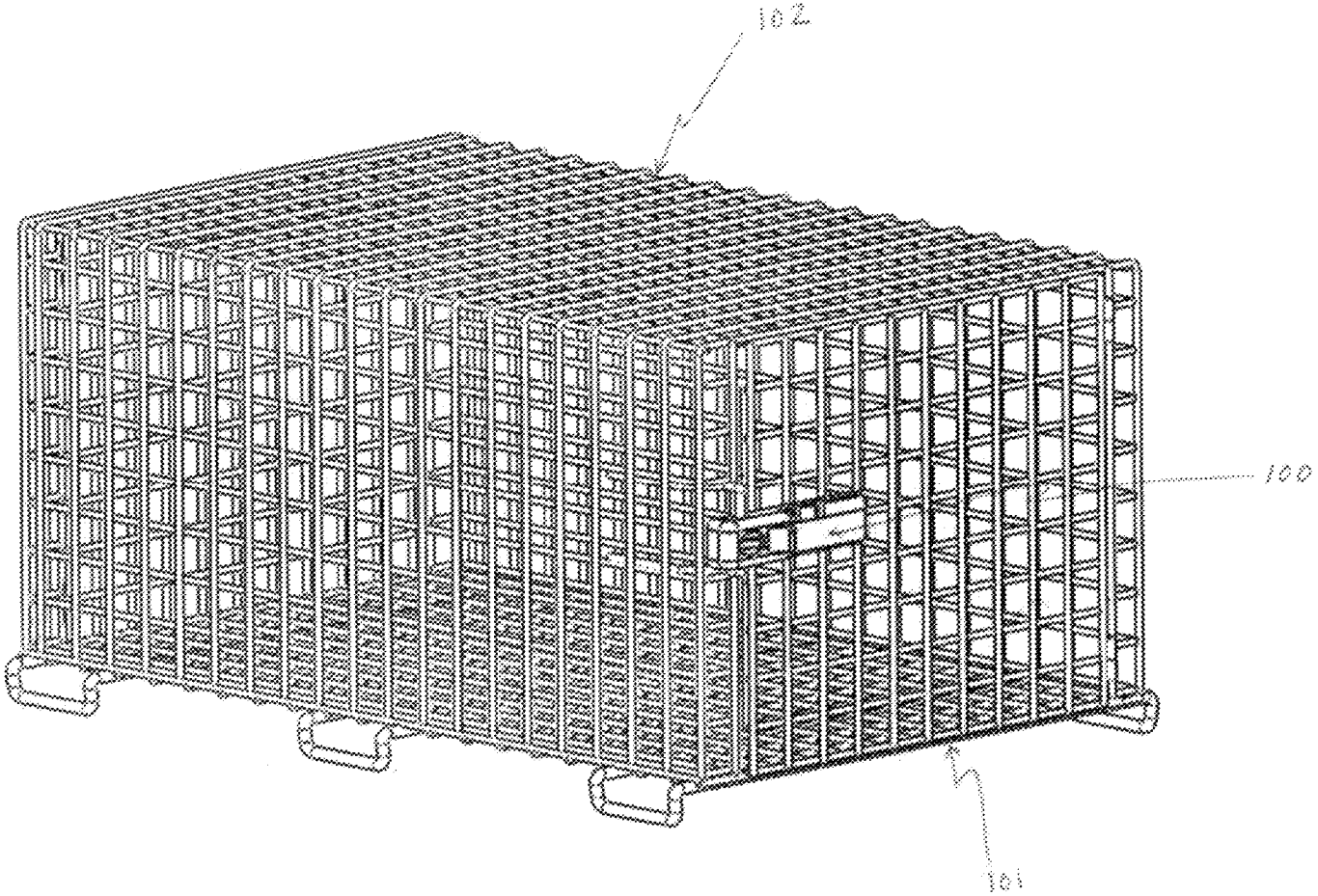
FIG. 43 is a perspective view of an eighth embodiment of a lock for use in connection with a cage with a single wire cage door, and illustrating the single wire cage door closed and the lock in a locked position.
Figure 44:
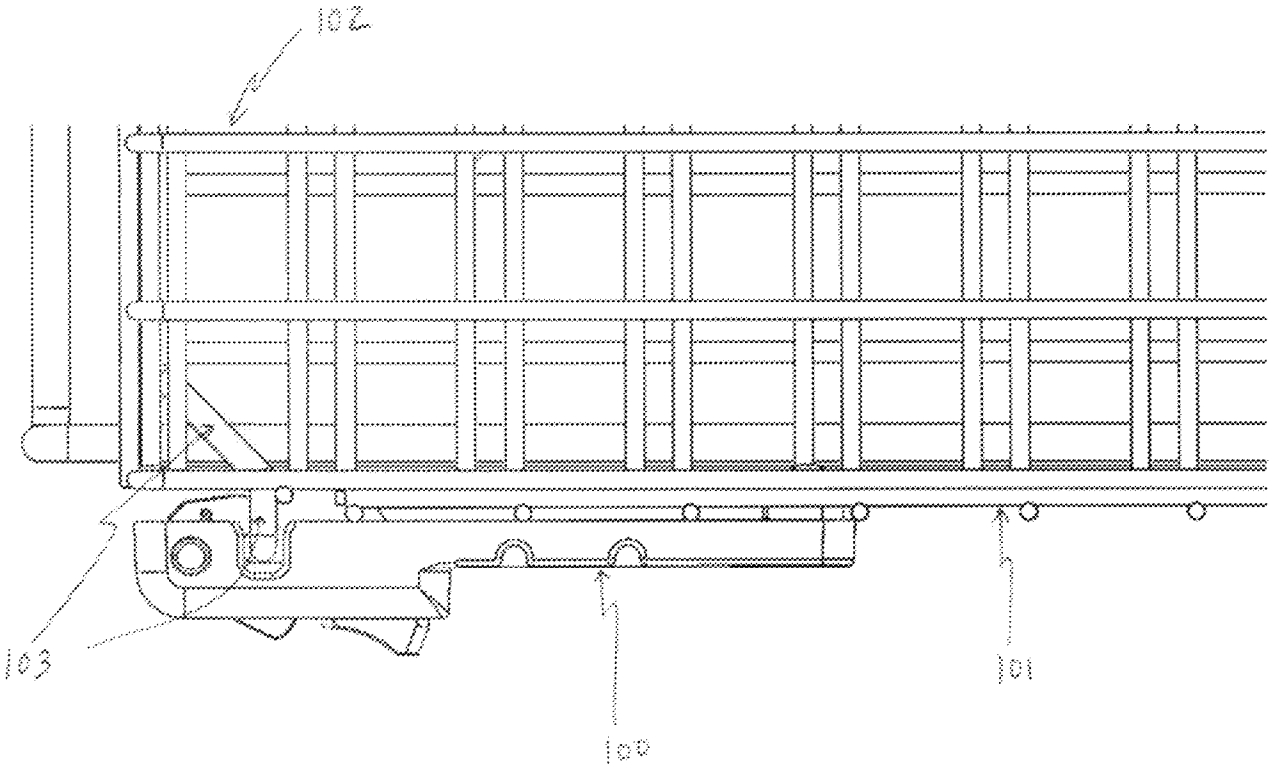
FIG. 44 is an enlarged partial top view of FIG. 43.
Figure 45:
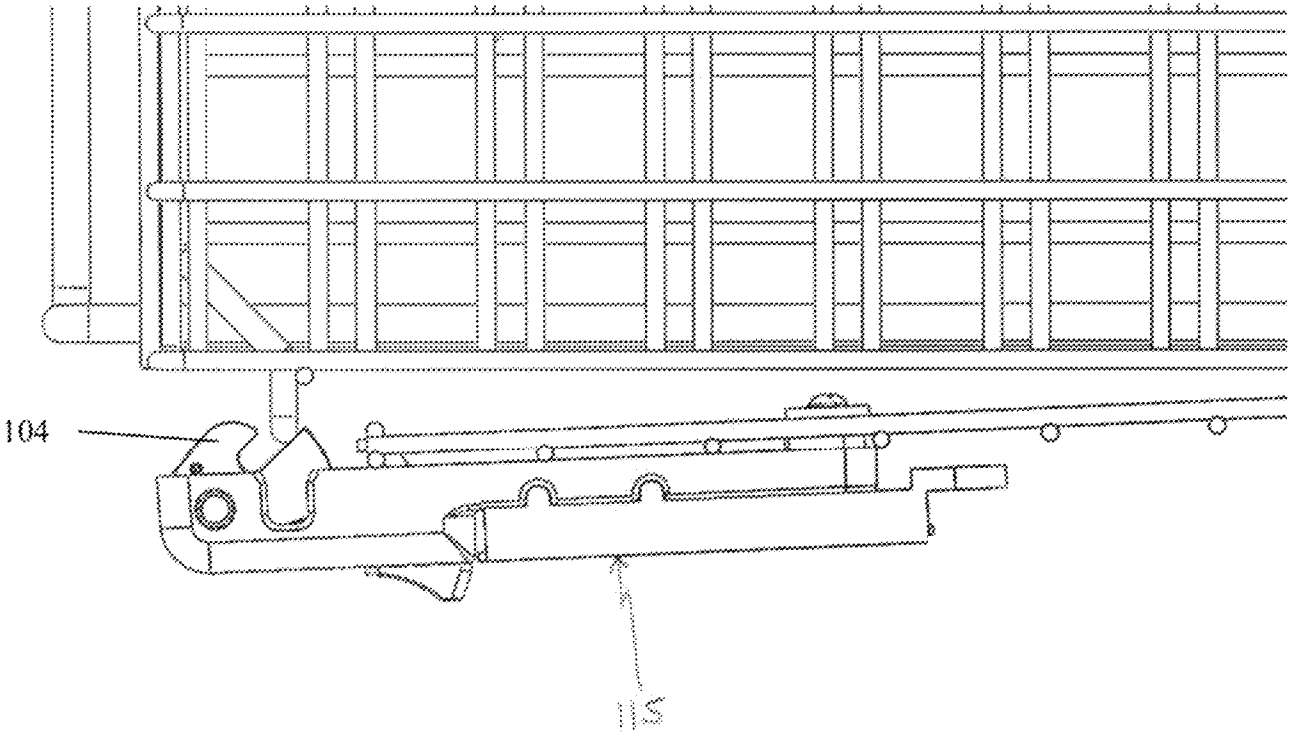
FIG. 45 is an enlarged partial top view of the eighth embodiment, and illustrating the single wire cage door opened and the placement and use of a magnetic key to free the latching mechanism.

FIGS. 43-45 shows the cage 102 with swinging door 101. Door 101 is optionally biased by a spring (not shown) toward its closed position. Rotor latch or lock 100 is suitably mounted to door 101, for example via one or more clips, brackets or clasping to a wire surface of the door. FIG. 43 shows the rotor latch 100 applied in the locked position, keeping door 101 from disengaging from cage 102. As shown in FIGS. 44 and 45, the lock 100 on door 101 has is a latch cam 104 as a latch element. The latch cam 104 is selectively latched behind a strike 103 on the cage or bin 102. In FIG. 44, the cam 104 is latched to strike 103 in the locked position to lock the door 101 to the cage 102. In FIG. 45, the cam 104 is in the unlatched position with a magnetic key 115 applied to thereby allow the door 101 (shown slightly open) to swing open.

Figure 46:
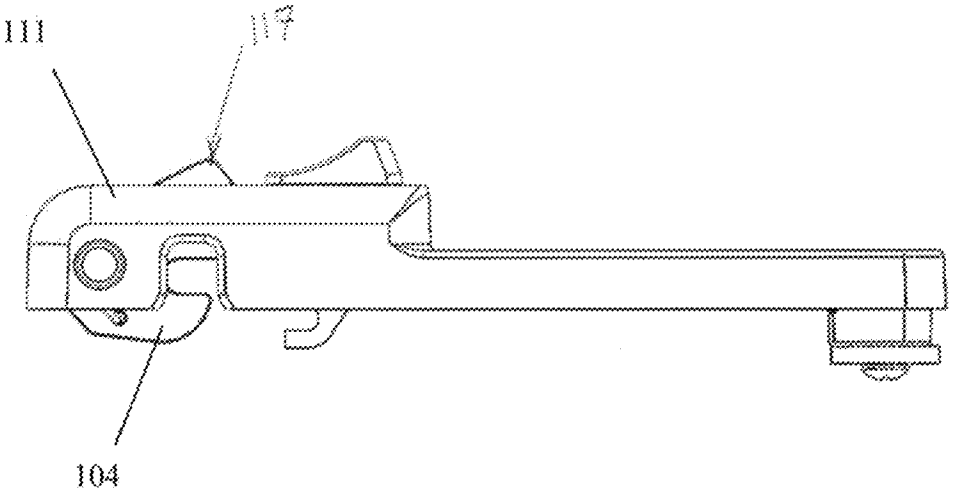
FIG. 46 is a side view of the lock of the eighth embodiment, in a locked position.
Figure 47:
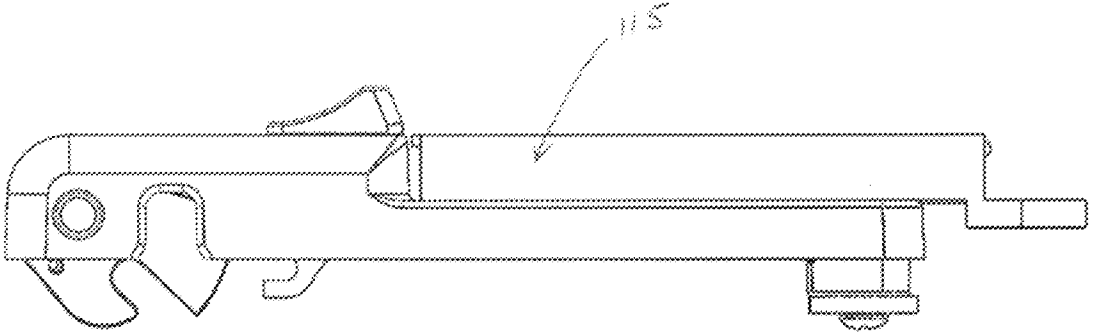
FIG. 47 is a side view of the lock of the eighth embodiment, in an unlocked position.
Figure 48:
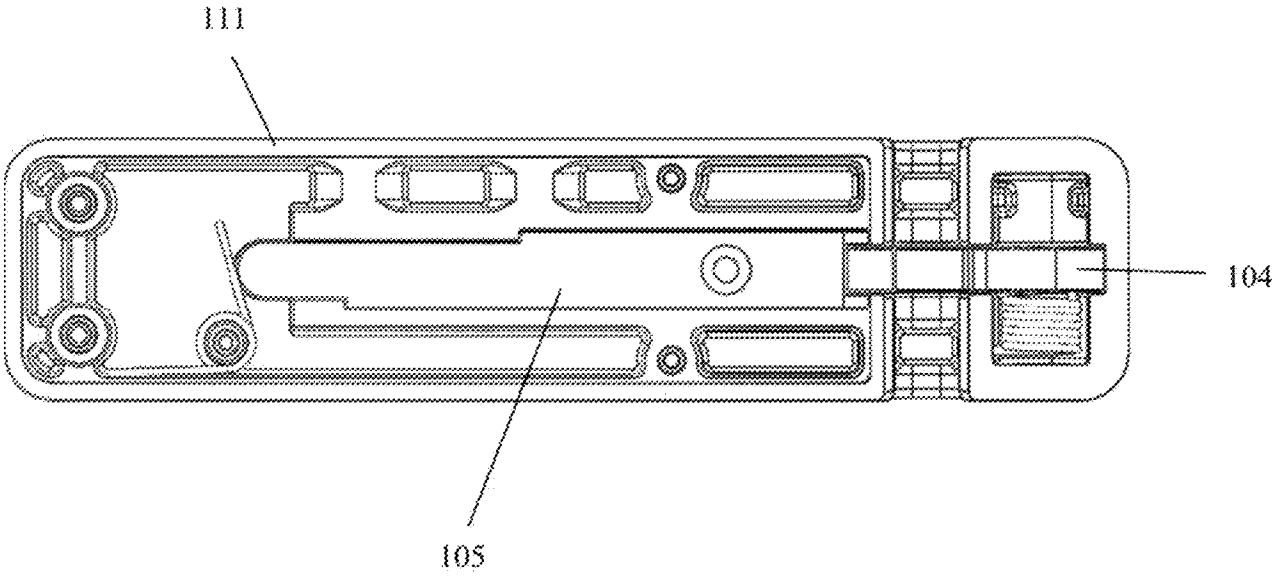
FIG. 48 is a bottom view of the lock of the eighth embodiment, in an unlocked position.
Figure 49:
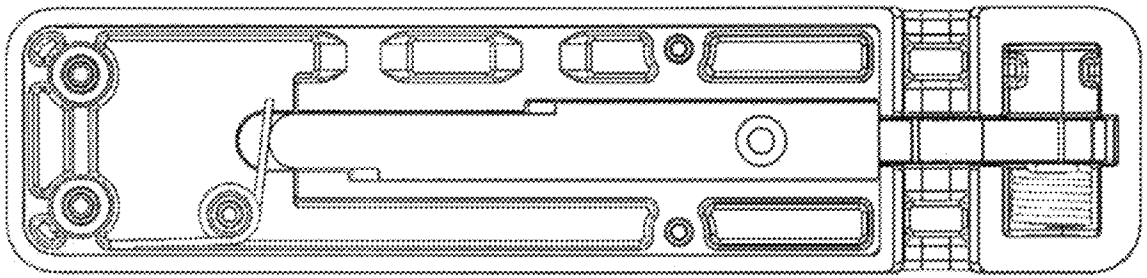
FIG. 49 is a bottom view of the lock of the eighth embodiment, in a locked position.

FIGS. 46 and 49 show a side view and a bottom view respectively of the lock 100 in the locked position, disconnected from the cage door. FIGS. 47 and 48 show a side view and a bottom view respectively of the lock 100 in the unlocked position. As can be seen in FIG. 46, a top surface 117 of cam 104 protrudes through lock housing 111 when in the locked position, indicating the locked position to the user. As seen in FIG. 47, a magnetic key 115 is used to unlock the lock 100 as described in more detail below.

Figure 50:
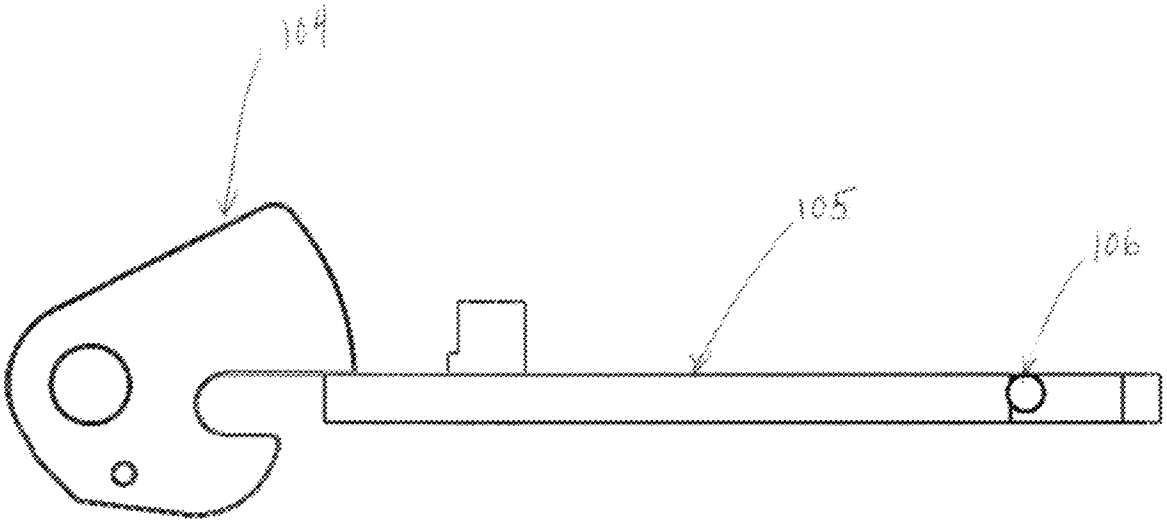
FIG. 50 is a side view of the latching mechanism and the lock latch of the eighth embodiment in locked position, and illustrating the latching mechanism extended to prevent movement of the lock latch from its locked position.
Figure 51:
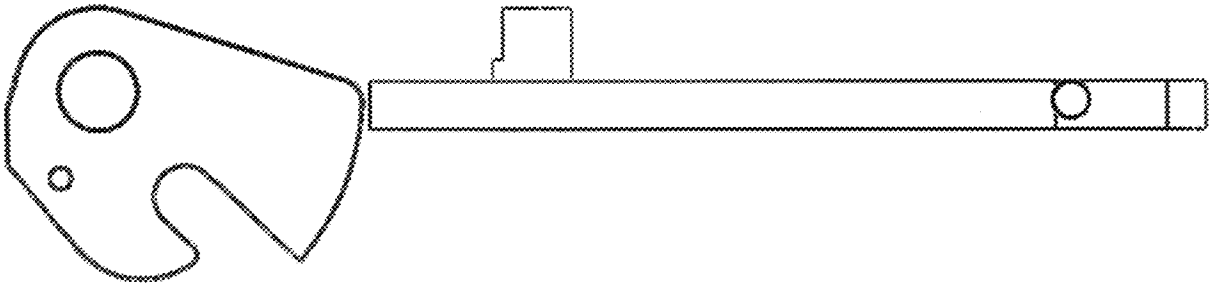
FIG. 51 is a side view of the latching mechanism and the lock latch of the eighth embodiment in unlocked position, and illustrating the latching mechanism retracted to allow is movement of the lock latch to its unlocked position.

Inside lock housing 111 is a locking slider or latch 105, which is selectively engaged and disengaged from the earn 104, as shown in FIGS. 50 and 51 respectively. FIG. 50 shows the latch cam 104 being restricted by locking slider 105 in the locked position. FIG. 51 shows the latch cam 104 un-restricted by locking slider 105 in the unlocked position. Operation of these components will be described next with respect to FIG. 52.

Figure 52:
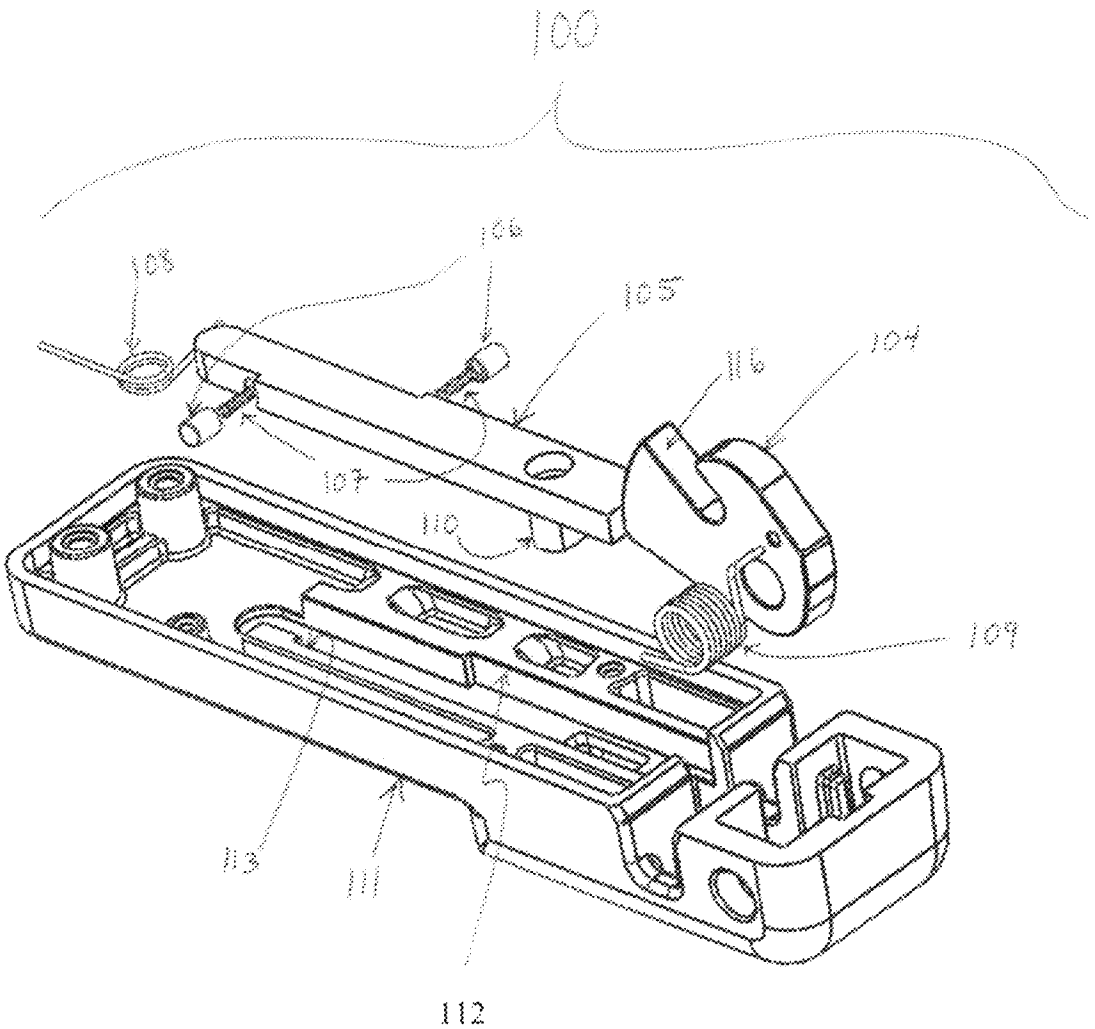
FIG. 52 is an exploded perspective view of the lock of the eighth embodiment.

The components of rotor latch or lock 100 can be seen in the exploded bottom perspective view of FIG. 52. The lock 100 includes a housing 111, a slider latch 105 in the housing, an operator 110 attached to the slider latch 105 for manually moving the slider latch 105, a slider spring 108 for biasing the slider latch, a rotor cam 104 for selectively engaging strike 103, a cam bias spring 100 for biasing the rotor cam 104, locking members 106 for selectively locking the slider latch 105, and locking springs 107 for biasing the locking members 106.

Slider latch 105 is biased toward earn 104, and cam 104 is biased by spring 109 to the unlatched position as shown in FIGS. 45, 47, 51 and 52. When door 101 is closed, strike 103 will contact rotor 104 at surface 116 (as shown in FIG. 45), causing rotor 104 to rotate counterclockwise (from the perspective of FIG. 52) to the closed position as shown in FIGS. 44, 46 and 50, at which time spring 108 will force slider 105 to slide toward cam 104. i.e., from its position in FIG. 51 to its position in FIG. 50, to block cam 104 at surface 116 in the closed position. In this locked and latched/closed position, lock elements 106 are biased into slots or profiles 112 and 113 respectively in housing 111 to prevent the slider 105 from moving against the biasing force of spring 108 and out of its latched/closed position. In this manner, operator 110 cannot unlatch slider 105 from its blocking position of cam 104 while lock dements are extended into the slots 112 and 113, as shown in FIG. 49.

When magnetic key 115 is applied to the exterior surface of housing 111, the magnets in the magnetic key 115 line-up with magnetically-sensitive material in lock members 106, and lock members 106 will withdraw from slots 112 and 113 into bores in the slider 105, freeing slider 105 and allowing the operator 110 to move slider 105 against spring force 108 to unblock slider 105 from the surface 116 of cam 104. When cans 104 is no longer blocked, cam 104 will spring out clockwise (again from the perspective of FIG. 52) via spring 109 to its unlatched position as shown in FIGS. 45, 47, 51 and 52, and disengaging from strike 103. The slider 105 then contacts a side of the cam 104 and is thus prevented from moving to its locked position. One of the advantages of this eighth embodiment is the rotor latch 100 will simultaneously latch and lock the door when the door is closed without a secondary manual locking operation, and the operator 110 can only move the slider 105 when the magnetic key 115 is applied to retract lock members 106 and allow the slider 105 to slide out of contact with the cam 104.

While the preferred and alternate embodiment(s) are illustrative of the structure, function and operation of the exemplary method(s), system(s) and device(s), it should be understood that various modifications may be made thereto with departing from the teachings herein. For example, the lock can be mounted on the storage container, and the latch can engage a portion of the door, cover lid or other such closure device, or a strike or bracket with slot attached thereto.

While the foregoing discussion presents the teachings in an exemplary fashion with respect to the disclosed methods, systems and devices for locks tor storage containers, it will be apparent to those skilled in the art that the teachings may apply to any type of locks. Further, while the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein.

What is claimed is:

1. A storage bin and locking system comprising:

a bin defining a storage area and having a first cover moveably attached to the bin, and a second cover moveably attached to the bin, wherein the first cover and the second cover are each selectively positionable in a closed position and an unclosed position, wherein the first cover and the second cover together cover the storage area of the bin when both are in their closed positions;

a lock bracket having a first mounting arm, a second mounting arm, and a plate extending between the first mounting arm and the second mounting arm, wherein the first mounting arm and the second mounting arm are attached to the first cover;

a lock mounted on the plate, wherein the lock includes a locking mechanism;

a bin bracket on the bin, wherein the bin bracket includes a locking element;

wherein the locking mechanism of the lock selectively engages the locking element of the bin bracket to lock the storage bin when the first cover and the second cover both are in their closed positions; and wherein the plate is moveably attached to the first mounting arm and the second mounting arm.

2. The storage bin and locking system of claim 1, wherein the lock bracket prevents movement of the first cover and the second cover from their closed positions to their unclosed positions when the locking mechanism engages the locking element.

3. The storage bin and locking system of claim 1, wherein the plate is selectively positionable between a lockable position and a non-lockable position, wherein the locking mechanism is engagable with the locking element when the plate is in its lockable position.

4. The storage bin and locking system of claim 1, wherein the locking mechanism is a latch.

5. The storage bin and locking system of claim 1, wherein the locking element is a portion of the bin bracket having a slot.

6. The storage bin and locking system of claim 1, wherein the first mounting arm and the second mounting arm are perpendicular to a back edge of the plate.

7. The storage bin and locking system of claim 1, wherein the plate is attached to the first mounting arm via a first hinge, and wherein the plate is attached to the second mounting arm via a second hinge.

8. The storage bin and locking system of claim 1, wherein the lock bracket is generally C-shaped.

9. A storage bin and locking system comprising:

a bin defining a storage area and having a first cover moveably attached to the bin, and a second cover moveably attached to the bin, wherein the first cover and the second cover are each selectively positionable in a closed position and an unclosed position, wherein the first cover and the second cover together cover the storage area of the bin when both are in their closed positions;

a lock bracket having a first mounting arm, a second mounting arm, and a plate extending between the first mounting arm and the second mounting arm, wherein the first mounting arm and the second mounting arm are attached to the first cover;

a lock mounted on the plate, wherein the lock includes a locking mechanism;

a bin bracket on the bin, wherein the bin bracket includes a locking element;

wherein the locking mechanism of the lock selectively engages the locking element of the bin bracket to lock the storage bin when the first cover and the second cover both are in their closed positions;

wherein the first mounting arm and the second mounting arm overlie at least a portion of the second cover when the first cover and the second cover both are in their closed positions; and wherein the first cover and the second cover have raised side edge surfaces, and wherein the first mounting arm and the second mounting arm overlie the raised side edge surfaces of the first cover and the second cover.

10. The storage bin and locking system of claim 9, wherein the locking mechanism is a latch.

11. The storage bin and locking system of claim 9, wherein the locking element is a portion of the bin bracket having a slot.

12. The storage bin and locking system of claim 9, wherein the first mounting arm and the second mounting arm are perpendicular to a back edge of the plate.

13. The storage bin and locking system of claim 9, wherein the plate is attached to the first mounting arm via a first hinge, and wherein the plate is attached to the second mounting arm via a second hinge.

14. The storage bin and locking system of claim 9, wherein the lock bracket is generally C-shaped.

15. The storage bin and locking system of claim 9, wherein the lock bracket prevents opening of the first hinged cover and the second hinged cover when the lock bracket is in the closed position.

16. The storage bin and locking system of claim 9, wherein the plate is selectively positionable between a lockable position and a non-lockable position, wherein the locking mechanism is engagable with the locking element when the plate is in its lockable position.

17. A method of locking a storage bin defining a storage area and having a first hinged cover and a second hinged cover, the method comprising the steps of:

mounting on the first cover a lock bracket having a first mounting arm, a second mounting arm, and a plate extending between the first mounting arm and the second mounting arm, wherein the plate is moveably attached to the first mounting arm and the second mounting arm;

mounting a lock having a locking mechanism on the plate;

providing a bin bracket on the bin;

providing a locking element on the bin bracket;

closing the second hinged cover to cover a portion of the storage area, after mounting the lock and the locking element;

closing the first hinged cover to cover a remaining portion of the storage area, after closing the second hinged cover, wherein the lock bracket overlies at least a portion of the second hinged cover; and engaging the lock with the locking element to selectively lock the covers on the bin.

18. The method of claim 17, wherein the step of engaging the lock with the locking element comprises the steps of positioning the plate from a non-lockable position to a lockable position and engaging the locking mechanism with the locking element when the plate is in its lockable position.

* * * * *